US006481429B2

(12) United States Patent
Nishio et al.

(10) Patent No.: US 6,481,429 B2
(45) Date of Patent: Nov. 19, 2002

(54) SIMULATED GUN

(75) Inventors: Koichi Nishio, Kobe (JP); Yuji Tamura, Akashi (JP); Satoshi Ueda, Kobe (JP)

(73) Assignee: Konami Corporation, Tokyo (JP)

( * ) Notice: Subject to any disclaimer, the term of this patent is extended or adjusted under 35 U.S.C. 154(b) by 0 days.

(21) Appl. No.: 09/766,983

(22) Filed: Jan. 22, 2001

(65) Prior Publication Data

US 2001/0010221 A1 Aug. 2, 2001

(30) Foreign Application Priority Data

Jan. 20, 2000 (JP) ..... 2000-014259

(51) Int. Cl.[7] ..... F41B 7/08
(52) U.S. Cl. ..... 124/29; 124/26; 124/54
(58) Field of Search ..... 124/16, 26, 27, 124/29, 42, 54

(56) References Cited

U.S. PATENT DOCUMENTS

| | | | | |
|---|---|---|---|---|
| 1,489,191 A | | 4/1924 | Chester | |
| 1,547,834 A | * | 7/1925 | Smookler | 124/42 X |
| 2,111,952 A | | 3/1938 | Tratsch | |
| 3,191,588 A | * | 6/1965 | Thew | 124/27 |
| 3,515,114 A | * | 6/1970 | Carbonneau | 124/27 |
| 3,845,957 A | | 11/1974 | Lohr et al. | |
| 4,225,140 A | | 9/1980 | D'Andrade et al. | |
| 4,759,551 A | | 7/1988 | Crompton | |
| 4,910,646 A | * | 3/1990 | Kim | 124/42 X |
| 5,224,860 A | | 7/1993 | Waldman et al. | |
| 5,326,108 A | | 7/1994 | Faith | |
| 5,445,138 A | * | 8/1995 | Faith | 124/16 |
| 5,460,384 A | | 10/1995 | Seidel et al. | |
| 5,613,482 A | * | 3/1997 | Thai et al. | 124/16 |
| 5,669,607 A | | 9/1997 | Silver et al. | |
| 6,144,375 A | | 11/2000 | Jain et al. | |

FOREIGN PATENT DOCUMENTS

| | | |
|---|---|---|
| JP | 9-14764 | 1/1934 |
| JP | 01-291887 | 11/1989 |
| JP | 5-68577 | 9/1993 |
| JP | 07-181934 | 7/1995 |
| JP | 08-299585 | 11/1996 |
| JP | 09-075552 | 3/1997 |
| JP | 9-140941 | 6/1997 |
| JP | 09192353 | 7/1997 |
| JP | 09-239151 | 9/1997 |
| JP | 9-271582 | 10/1997 |
| JP | 9-271583 | 10/1997 |
| JP | 10-230081 | 9/1998 |
| JP | 11-047432 | 2/1999 |
| JP | 11-047433 | 2/1999 |
| JP | 11-146977 | 6/1999 |
| JP | 00-233066 | 8/2000 |
| JP | 2001-353354 | 12/2001 |

OTHER PUBLICATIONS

Fire Control Systems Kollsman, Inc. www.army–technology.com/–contractors/fire/kollsman Feb. 1, 1999 Syphon Filter Instruction Manual, 989 Studios, Inc.

* cited by examiner

*Primary Examiner*—John A. Ricci
(74) *Attorney, Agent, or Firm*—Jordan and Hamburg LLP

(57) ABSTRACT

A simulated gun for use with a disk-shaped or substantially disk-shaped flying member made of a metal as a bullet for discharging it forward, the simulated gun comprising: a gunbarrel having the hollow whose cross section along a direction normal to a flying direction of the flying member is vertically long and has vertical and horizontal dimensions set substantially equal to the diameter and the thickness of the flying member, respectively, and a flying member hitting position being set at the inner back position of the gunbarrel; a hammer provided at the inner back position of the gunbarrel, reciprocatingly movable between an advanced position where it hits the rear part of the flying member set at the flying member hitting position and a retracted position which is located in a rearward from the advance position, and adapted to hit the flying member set at the flying member hitting position, and a trigger for reciprocatingly moving the hammer.

20 Claims, 36 Drawing Sheets

TRIGGER ON

TRIGGER OFF

SIMULATED GUN

The present invention relates to a novel simulated gun for discharging token such as coins or medals.

BACKGROUND OF THE INVENTION AND RELATED ART STATEMENT

A generally known simulated gun is such that a bullet made of cork is loaded at a muzzle and discharged toward a target such as a premium in front to hit it.

However, in the case of shooting by the above known simulated gun, the bullet itself is relatively light and its trajectory is easy to deviate from a target position while it is flying. Even if the bullet hits the target, it is often by accident, but not by a result based on a shooting ability of a game player. Therefore, the conventional shooting game tends to lack ingenuity.

SUMMARY OF THE INVENTION

In view of the problems residing in the prior art, an object of the present invention is to provide a shooting game machine capable of improving the ingenuity of a game.

In order to fulfill the above object, a simulated gun for use with a disk-shaped or substantially disk-shaped flying member made of a metal as a bullet for discharging, according to the present invention, comprising: a gunbarrel having a hollow whose cross section along a direction normal to a flying direction of the flying member is vertically long and has vertical and horizontal dimensions set substantially equal to the diameter and the thickness of the flying member, respectively, and a flying member hitting position being set at the inner back position of the gunbarrel; a hammer provided at the inner back position of the gunbarrel, reciprocatingly movable between an advanced position where it hits the rear part of the flying member set at the flying member hitting position and a retracted position which is located in a rearward from the advance position, and adapted to hit the flying member set at the flying member hitting position, and a trigger for reciprocatingly moving the hammer.

These and other objects, features and advantages of the present invention will become more apparent upon a reading of the following detailed description and accompanying drawings.

DETAILED DESCRIPTION OF THE PREFERRED EMBODIMENT OF THE INVENTION

Hereinafter, one embodiment of the invention is specifically described with reference to the accompanying drawings.

Figure 1:
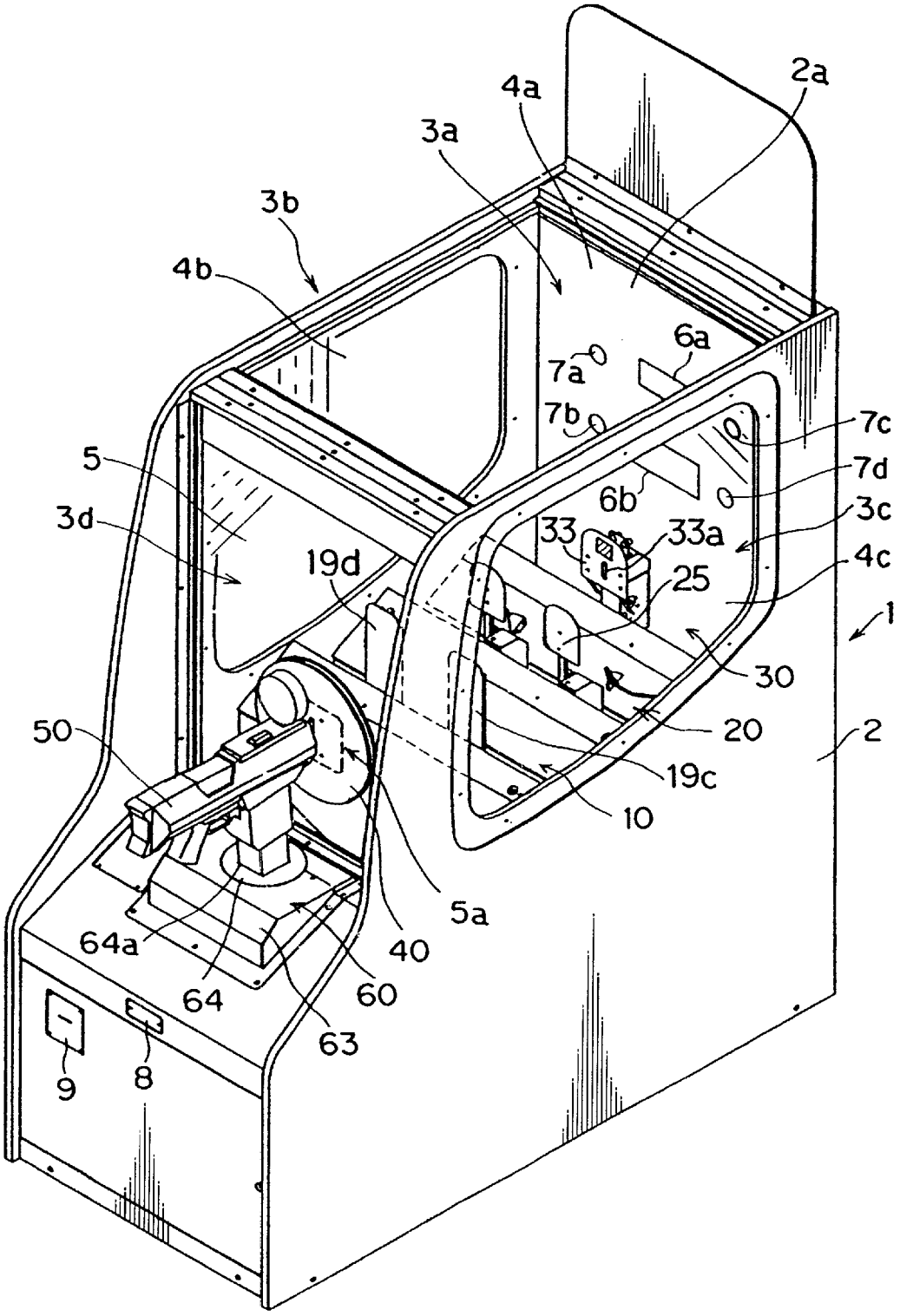
FIG. 1 is a perspective view showing the external construction of a shooting game machine in which a simulated gun according to one embodiment of the invention is applied.
Figure 2:
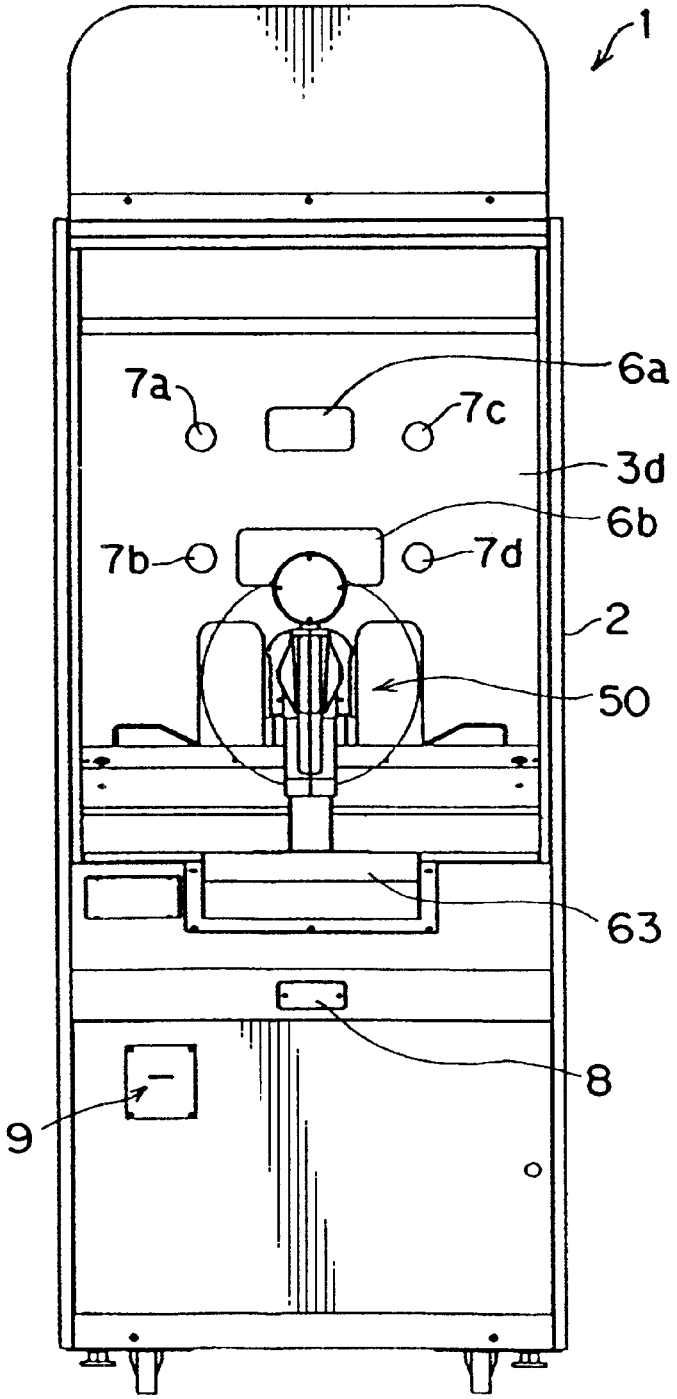
FIG. 2 is a front view of the shooting game machine of FIG. 1.
Figure 3:
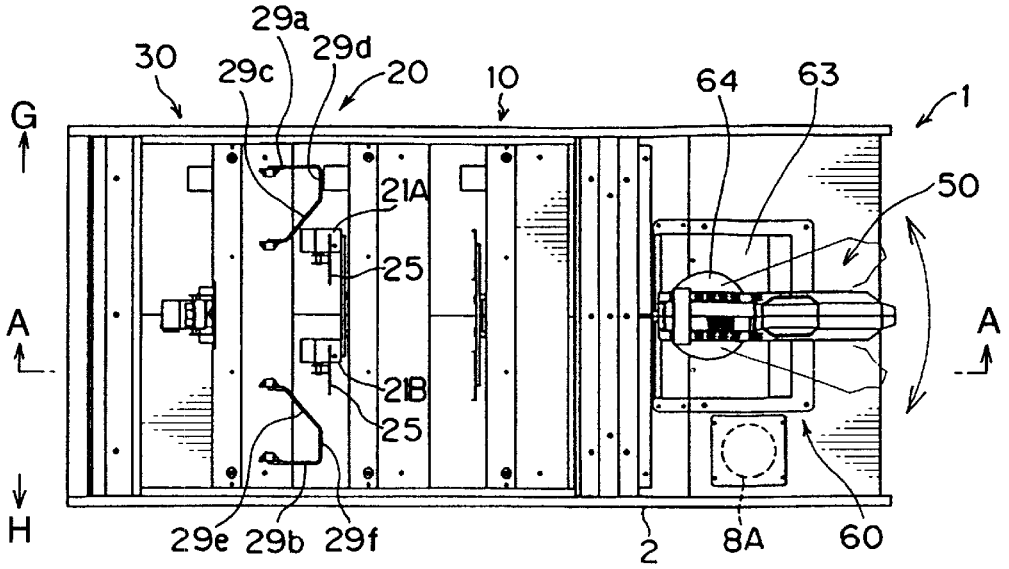
FIG. 3 is a plan view of the shooting game machine of FIG. 1.
Figure 4:
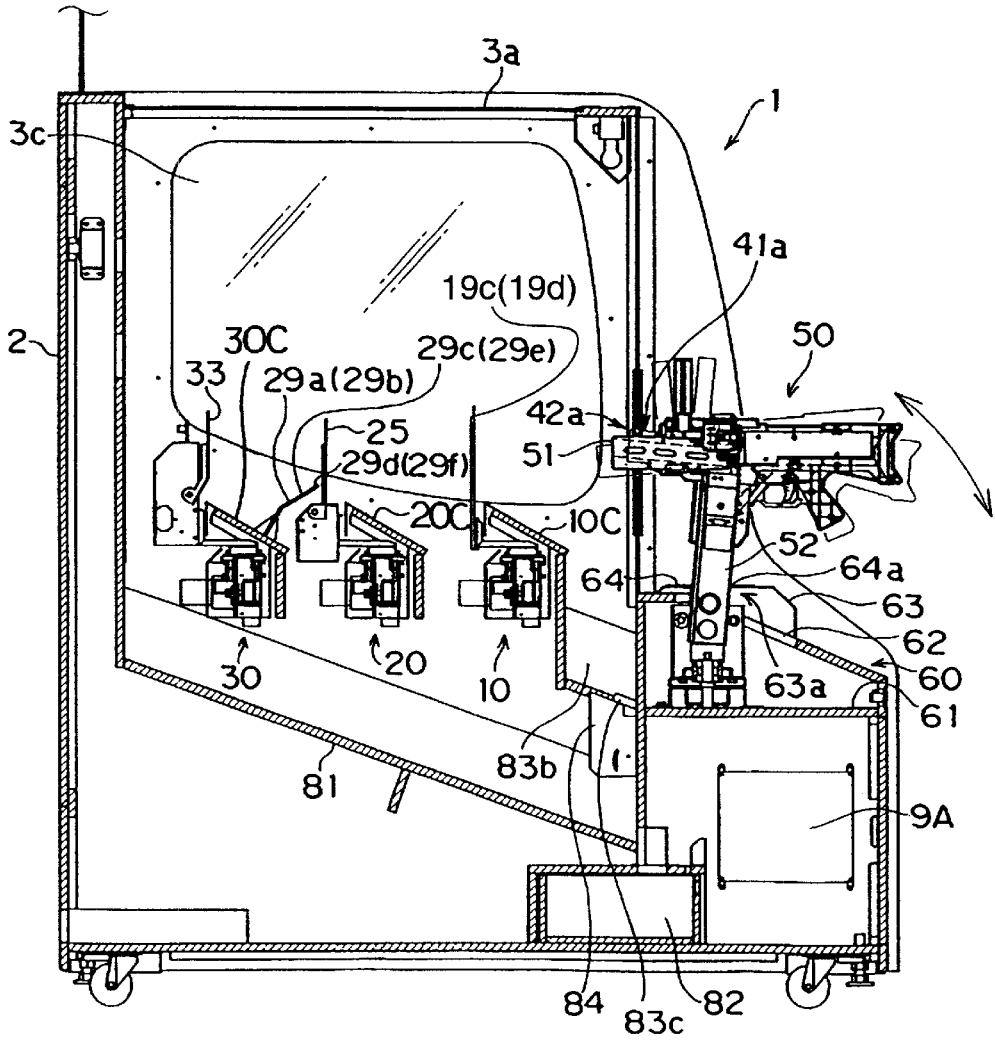
FIG. 4 is a section along A—A of FIG. 3.

FIG. 1 is a perspective view showing the external construction of a shooting game machine in which a simulated gun according to one embodiment of the invention is applied, FIG. 2 is a front view of the shooting game machine, FIG. 3 is a plan view of the shooting game machine, and FIG. 4 is a section along A—A of FIG. 3.

This shooting game machine 1 is provided with a casing 2 and a simulated gun (hereinafter, merely "gun") 50 according to one embodiment of the present invention. The casing 20 is formed with a window 3*a* in its ceiling surface, windows 3*b*, 3*c* in its opposite side surfaces, and a window 3*d* in its front surface. Transparent plate members 4*a*, 4*b*, 4*c* made of, e.g. an acrylic resin are fitted in the windows 3*a* to 3*c*. A transparent plate member 5 made of, e.g. an acrylic resin is also fitted in the front window 3*d*. This plate member 5 is formed with, for example, a substantially rectangular opening 5*a*, and a muzzle inserting member 40 is mounted in the opening 5*a*.

Inside the casing 2, two display devices 6*a*, 6*b* are provided on a rear surface 2*a*, the upper display device 6*a* being mainly adapted to display a score every time shooting is made and the lower display device 6*b* being mainly adapted to display a jackpot value. A plurality of (four in the shown embodiment) light sources for electric decorations, e.g. lamps 7*a*, 7*b*, 7*c*, 7*d* are provided on the rear surface 2*a*. Inside the casing 2 are provided one screening portion 10 and two target units 20, 30. The screening portion 10 is provided at a front position, the target unit 20 at a middle position and the target unit 30 at a rear position.

On the outer front surface of the casing 2 are provided a proximity sensor 8, a loudspeaker 8A and a ticket discharge opening 9. A ticket issuing device (ticket dispenser) 9A is provided inside the ticket discharge opening 9 (see FIG. 4), and a ticket dispensed from the ticket issuing device 9A is discharged through the ticket discharge opening 9.

Figure 5:
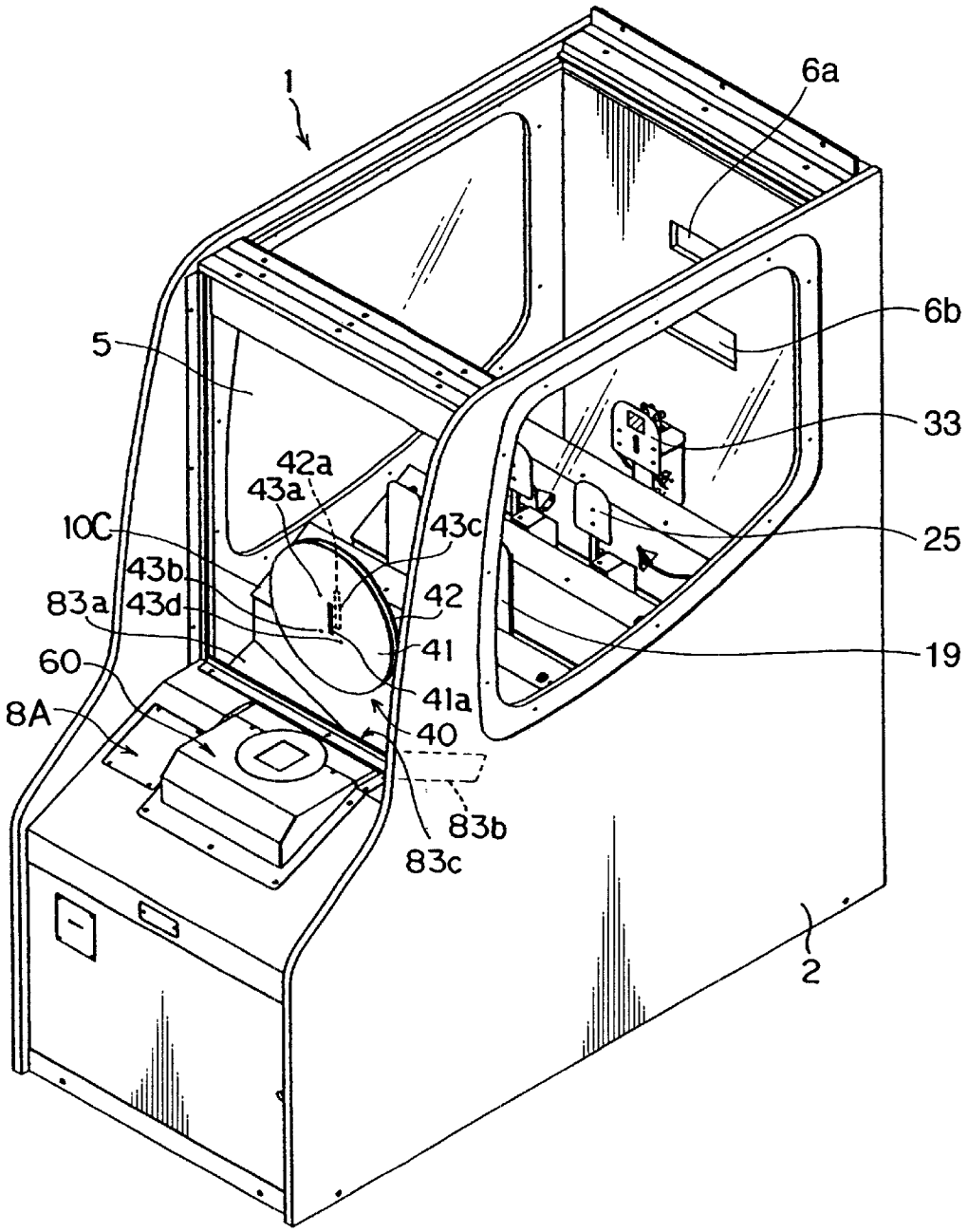
FIG. 5 is a perspective view showing the external construction of the shooting game machine of FIG. 1 without a simulated gun.

FIG. 5 is a perspective view showing the shooting game machine without the gun 50. As shown in FIG. 5, the aforementioned muzzle inserting member 40 is mounted on the plate member 5 and includes two disk-shaped plate members 41, 42, and four coupling members 43*a*, 43*b*, 43*c*, 43*d* for coupling the plate members 41, 42 to each other while spacing them at a specified distance.

The two plate members 41,42 are so provided as to hold the plate member 5 therebetween and are formed with slit-shaped muzzle insertion holes 41*a*, 42*a*. The positions and orientation of the muzzle insertion holes 41*a*, 42*a* are aligned with their longitudinal directions extending in vertical direction. The four coupling members 43*a*, 43*b*, 43*c*, 43*d* are provided at four corner positions of a rectangle, and are movable to up, down, left or right or in any desired direction within a specified range until they come into contact with the inner edge of the opening 5*a* while keeping defining the same rectangular.

A gun mounting portion 60 is mounted on the casing 2 before the plate member 5, and includes a gun mounting plate 61 inside the casing 2, an opening 62 formed above the gun mounting plate 61, an outer frame 63 mounted to close the opening 62, and a cover 64 mounted to close an opening 63*a* formed in an upper part of the outer frame 63 as shown in FIG. 4. The cover 64 is movable along the upper surface of the outer frame 63 and is formed with an opening 64*a* in its portion.

The gun 50 is mounted on the gun mounting plate 61 of the gun mounting portion 60 with the muzzle 51 inserted through the muzzle insertion holes 41*a*, 42*a*, and a supporting portion 52 provided at the bottom part of the gun 50 is inserted through the opening 64*a* of the cover 64.

Figure 6:
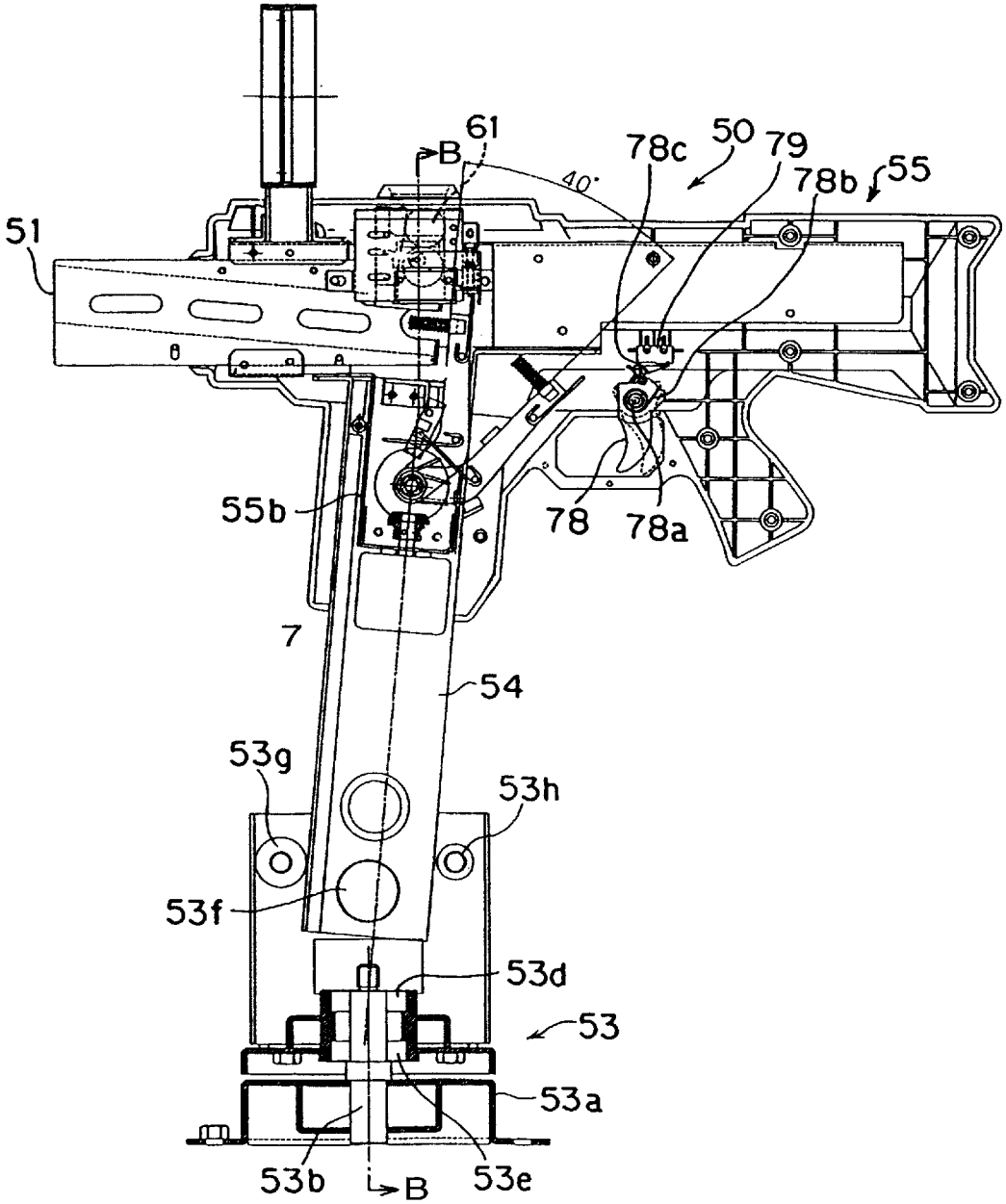
FIG. 6 is a front view of the simulated gun provided in the shooting game machine of FIG. 1.
Figure 7:
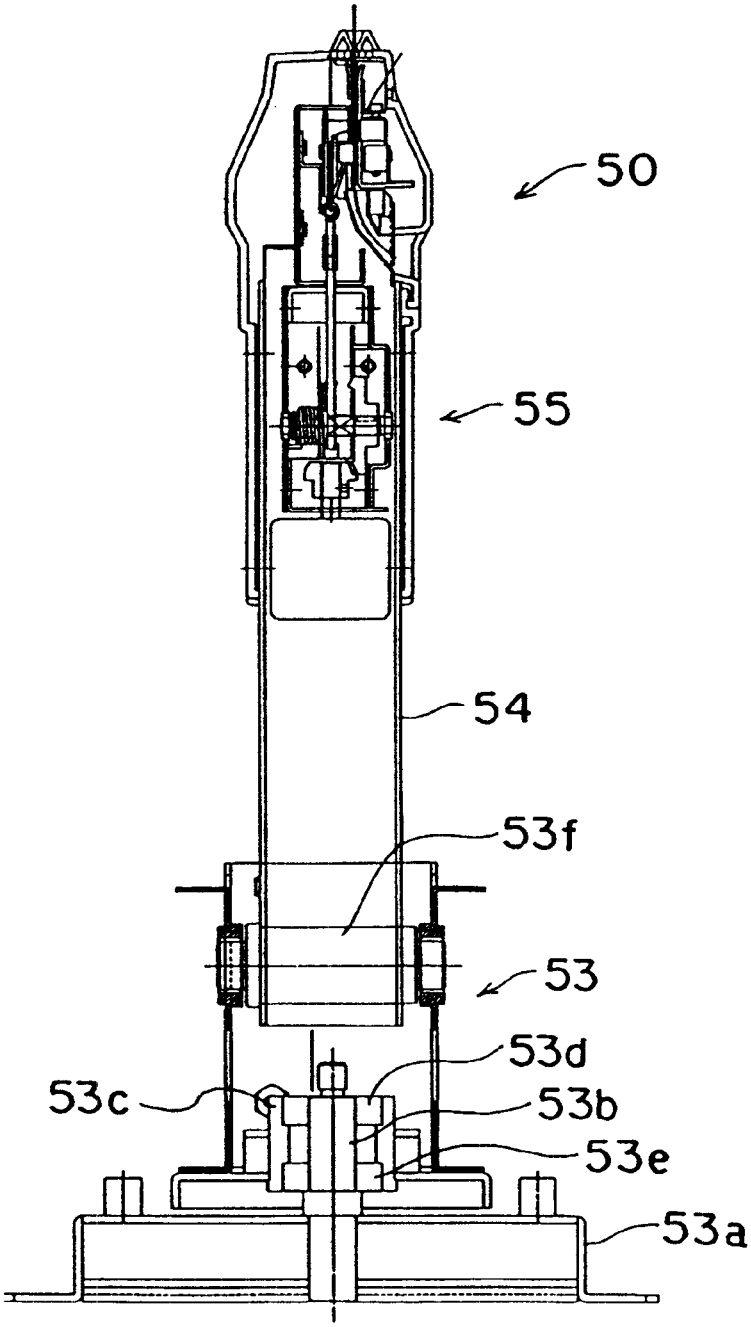
FIG. 7 is a section along B—B of FIG. 6, FIGS. 8A and 8B are an enlarged section of an upper part of the simulated gun of FIG. 7 and an enlarged section showing the upper part of the simulated gun of FIG. 7 with a maintenance cover as its part detached, respectively.
Figure 8A:
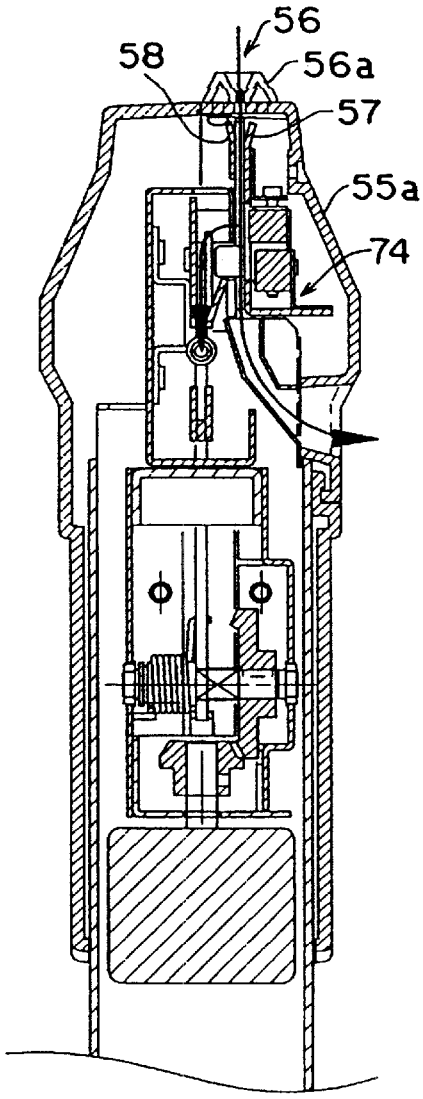
Figure 8B:
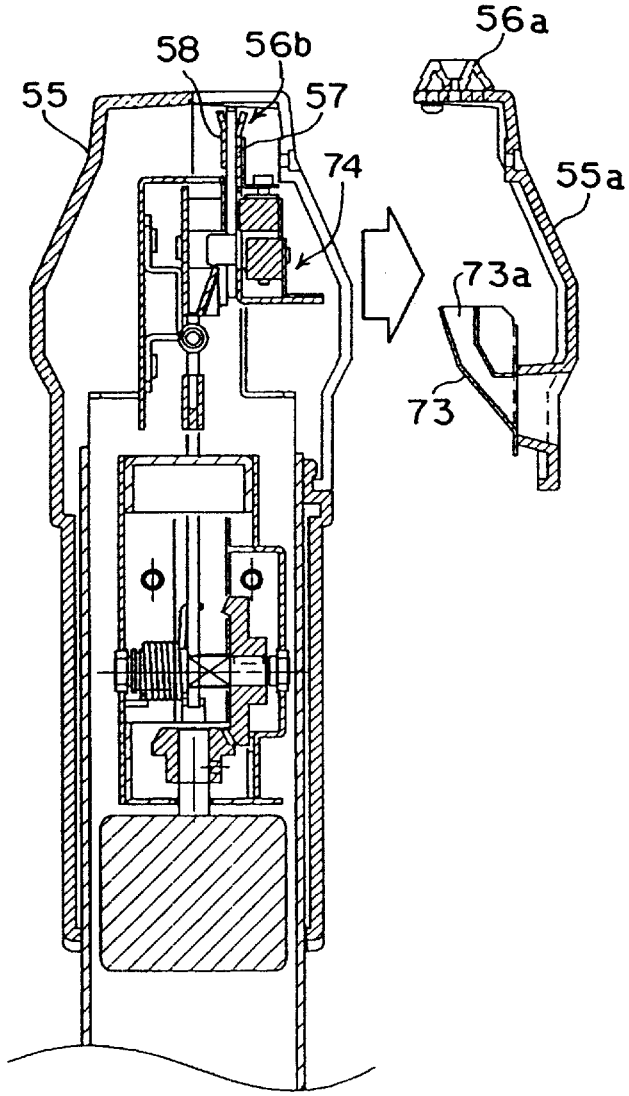
Figure 9A:
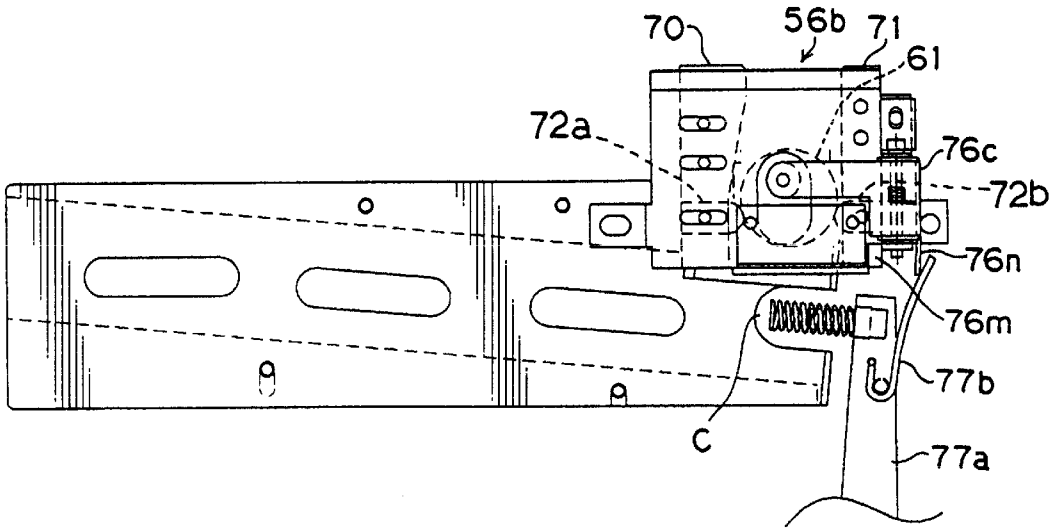
FIGS. 9A, 9B and 9C are a front view, a plan view and a left side view showing an essential portion of the simulated gun, respectively.
Figure 9B:
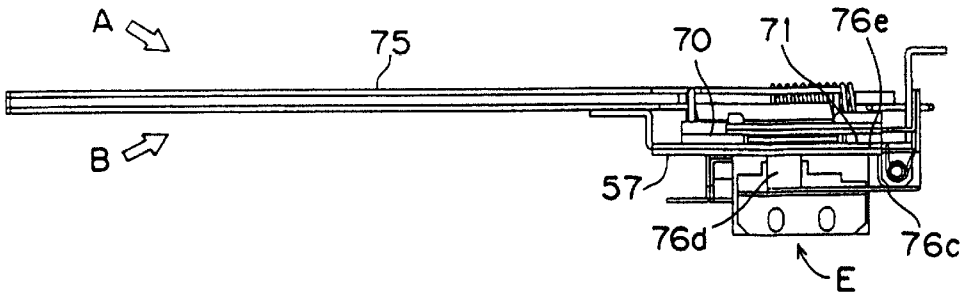
Figure 9C:
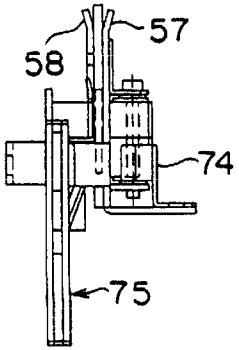
Figure 10A:
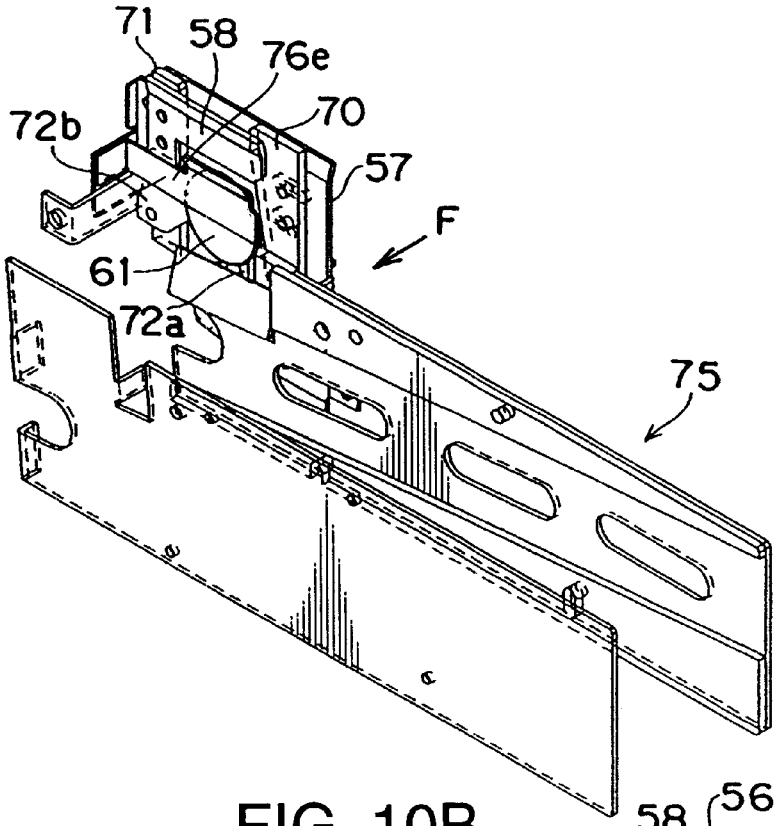
FIGS. 10A and 10B are a perspective view showing the essential portion of the simulated gun when viewed in a direction A of FIG. 9B and a perspective view showing the essential portion of the simulated gun when viewed in a direction B of FIG. 9B, respectively.
Figure 10B:
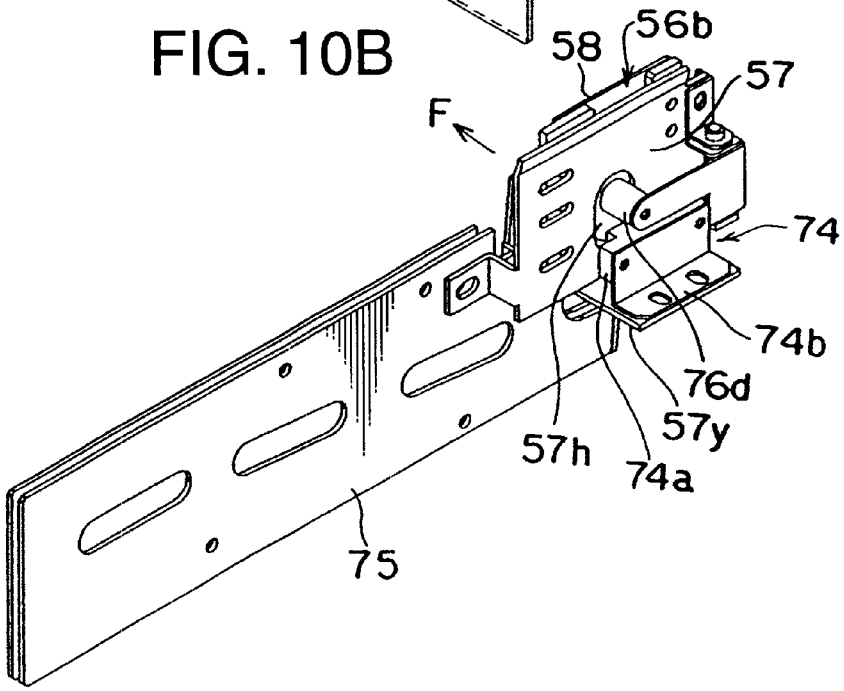
Figure 11:
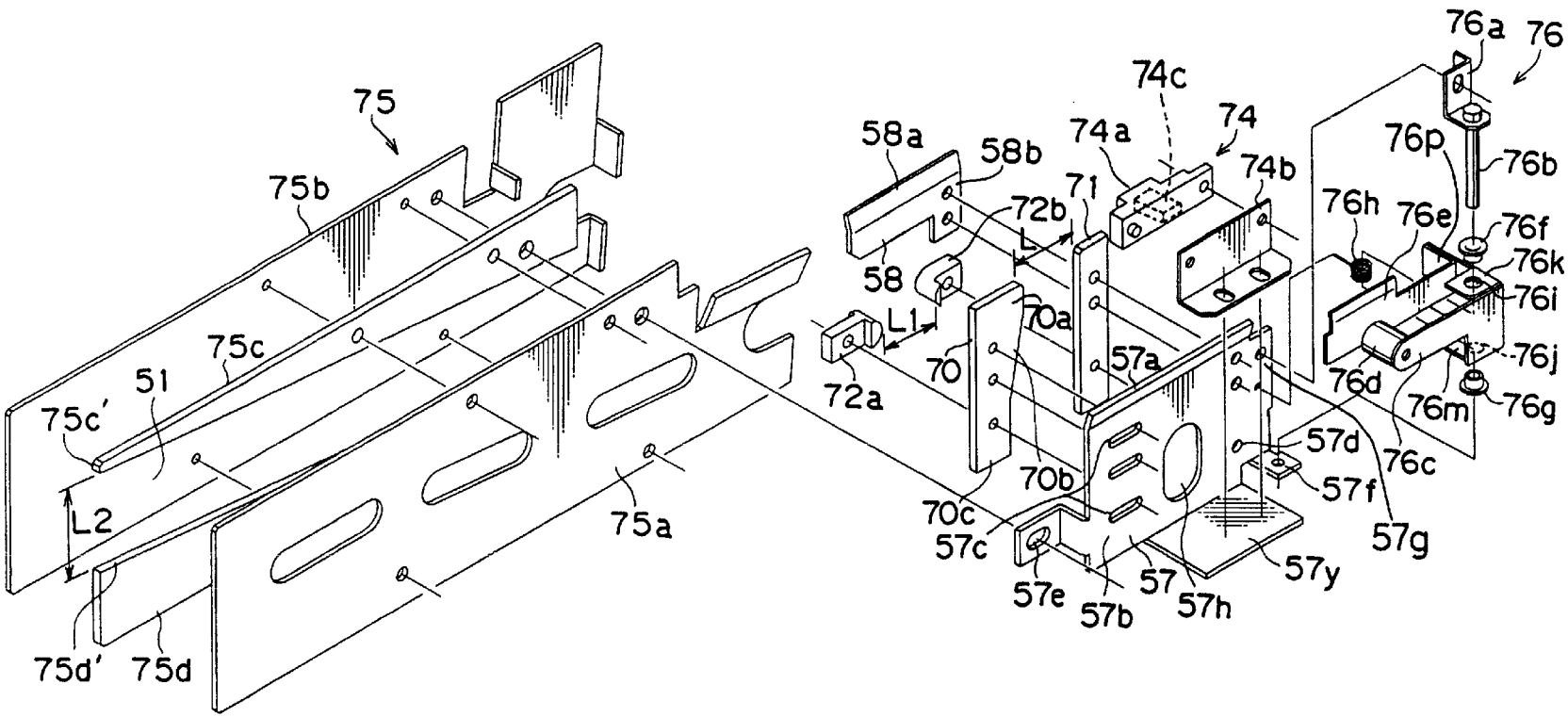
FIG. 11 is an exploded perspective view showing the essential portion of the simulated gun provided in the shooting game machine of FIG. 1, FIGS. 12A, 12B and 12C are a front view, a plan view and a left side view corresponding to FIGS. 9A to 9C and showing the essential portion of the simulated gun when a token is set in a token hitting position C.
Figure 12A:
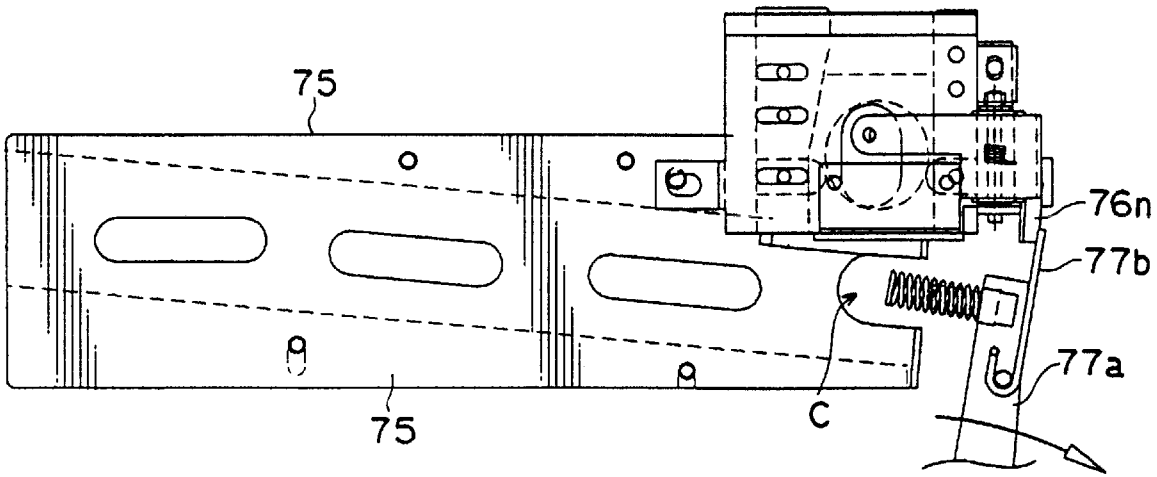
Figure 12B:
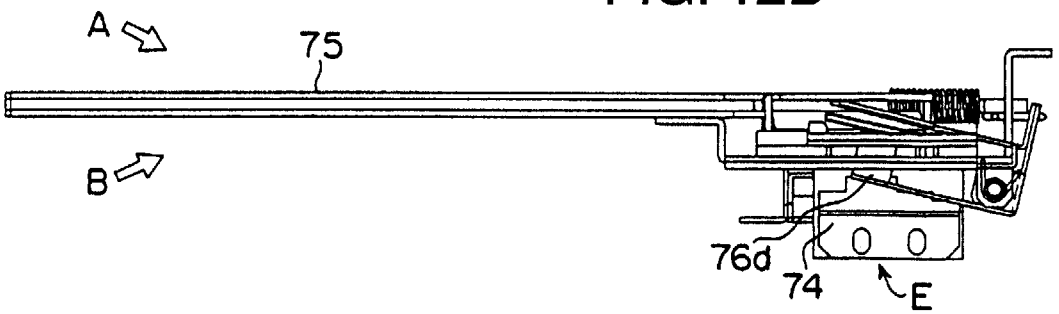
Figure 12C:
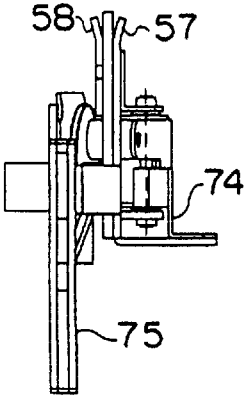
Figure 13A:
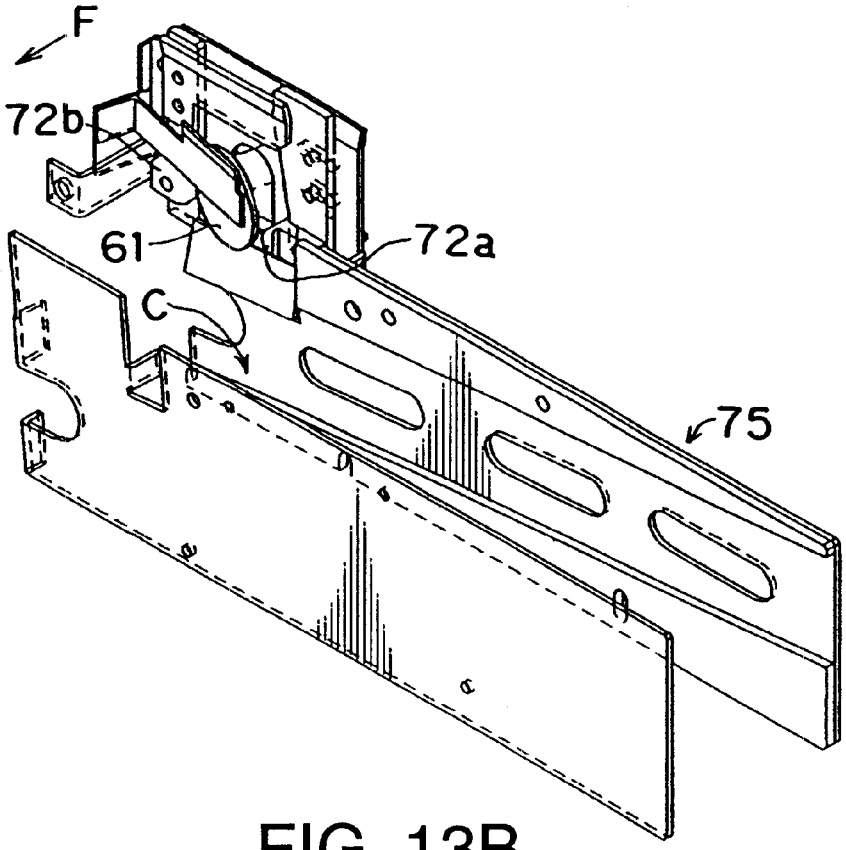
FIGS. 13A and 13B are perspective views corresponding to FIGS. 10A and 10B and showing the essential portion of the simulated gun when viewed in a direction A of FIG. 12B and when viewed in a direction B of FIG. 12B with the token set in the token hitting position C, respectively.
Figure 13B:
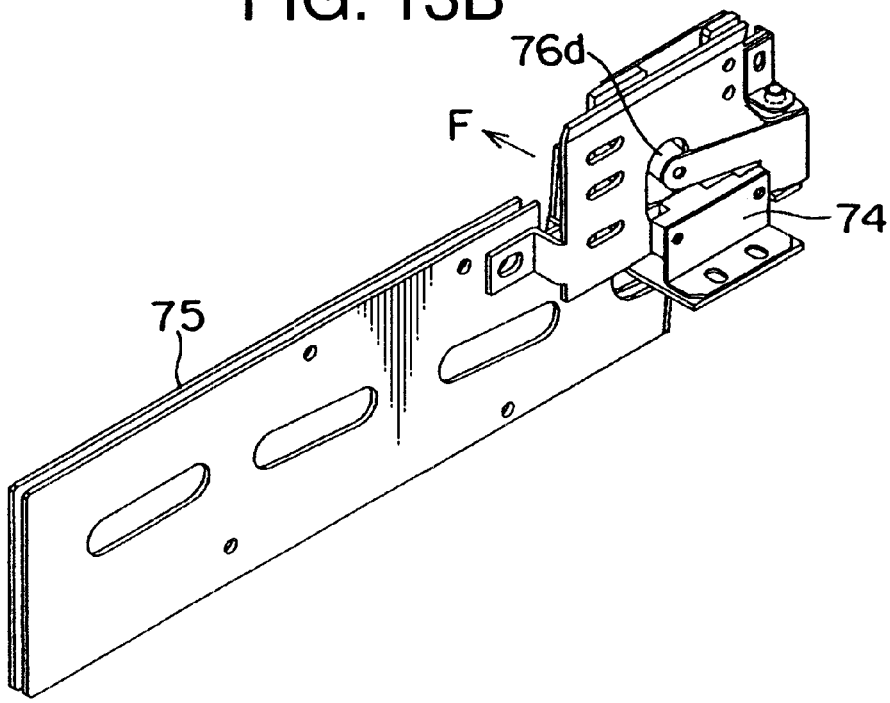

FIG. 6 is a front view showing the gun 50; FIG. 7 is a section along B—B of FIG. 6; FIGS. 8A and 8B are an enlarged section of an upper part of the gun 50 of FIG. 7 and an enlarged section showing the upper part of the gun with a maintenance cover as its part detached, respectively; FIGS. 9A, 9B and 9C are a front view, a plan view and a left side view showing an essential portion of the gun 50, respectively; FIGS. 10A and 10B are a perspective view showing the essential portion of the gun 50 when viewed in a direction A of FIG. 9B and a perspective view showing the essential portion of the gun 50 when viewed in a direction B of FIG. 9B, respectively; and FIG. 11 is an exploded perspective view showing the essential portion of the gun 50. Further, FIGS. 12A, 12B and 12C are a front view, a plan view and a left side view corresponding to FIGS. 9A to 9C and showing the essential portion of the gun 50 when a token is set in a token hitting position C; and FIGS. 13A and 13B are perspective views corresponding to FIGS. 10A and 10B and showing the essential portion of the gun 50 when viewed in a direction A of FIG. 12B and a perspective view showing the essential portion of the simulated gun when viewed in a direction B of FIG. 12B with the token set in the token hitting position C.

This gun 50 is, as shown in FIGS. 6 and 7, comprised of a fixed portion 53 provided at its bottom, a supporting portion 54 supported on the fixed portion 53 and a simulated gun main body (hereinafter, merely "gun main body") 55 provided on the supporting portion 54. The fixed portion 53 includes a fixed member 53*a* fixed to the gun mounting plate 61, a vertical shaft 53*b* standing on the fixed member 53*a*, and a rotary member 53*c* rotatably provided on a horizontal plane about the shaft 53*b*. Two bearings 53*d*, 53*e* are provided between the shaft 53*b* and the rotary member 53*c*.

A shaft 53*f* is horizontally provided at an upper part of the fixed portion 53, and the supporting portion 54 is rotatably mounted on the shaft 53*f* about a horizontal axis with its rotatable range specified by stoppers 53*g*, 53*h* provided at the opposite sides with respect to its rotating direction.

The gun main body 55 includes a token inserting portion 56 at its upper end as shown in FIG. 8A. The token inserting portion 56 is comprised of a token insertion guide 56*a* having a slit, and an insertion hole 56*b*. In the token insertion guide 56*a*, a slanted surface is formed at a side where the slit is formed, so that a token 61 can be easily introduced to the slit by the slanted surface. The insertion hole 56*b* is provided with two facing members 57, 58 in the thickness direction of the token 61 as shown in FIG. 10, and two restricting members 70, 71 for restricting the diameter of the token 61 are between the facing members 57, 58. The restricting members 70, 71 have a thickness slightly larger than the thickness of the token 61, and a spacing between the facing members 57, 58 is equal to the thickness of the restricting members 70, 71 so that the token 61 can fall without any problem.

As shown in FIG. 11, the facing members 57, 58 have slanted surfaces 57*a*, 58*a* which are inclined outwardly toward their top, and vertical surfaces 57*b*, 58*b* are formed below the slanted surfaces 57*a*, 58*a*. The restricting member 70 is comprised of a wide portion 70*a*, a slanted portion 70*b* and a narrow portion 70*c* from its upper end, whereas the other restricting member 71 has a constant width. A spacing L between the wide portion 70*a* and the restricting member 71 is slightly longer than the diameter of the token 61 so as to prevent tokens having a specified diameter or larger from being inserted. The restricting member 71 is mounted while being tightly held between the facing members 57, 58, whereas the restricting member 70 is mounted on the facing member 57 by fastening unillustrated screws through oblong holes 57*c* of the facing member 57, and the spacing L can be changed by changing the position (horizontal position) with respect to the oblong holes 57*c*. Stoppers 72*a*, 72*b* are mounted at bottom positions of the facing member 57. Specifically, the stopper 72*a* is mounted on the restricting member 70 and the stopper 72*b* is mounted on the facing member 57 via the restricting member 71 by fastening a screw through a round hole 57*d*. In other words, each of the stoppers 72*a*, 72*b* has one end thereof supported on the facing member 57 while the other end thereof unsupported (i.e., a cantilever type support). Further, the upper surfaces of the stoppers 72*a*, 72*b* are smooth surfaces free from projections or the like.

A spacing L1 between the stoppers 72*a*, 72*b* is set shorter than the diameter of the tokens 61 to stop the fall of specified tokens 61 while allowing tokens 61 having a diameter shorter than the specified tokens 61 and not to be used to fall. A plurality of (two in this example) tokens 61 can be inserted onto the stoppers 72*a*, 72*b*. It should be noted that the insertion of the tokens having the specified diameter or larger may be prevented by providing the token inserting device 56 with slits separately prepared for tokens of different diameters.

Below the facing members 57, 58 is, as shown in FIG. 8B, provided a discharging member 83 forming a discharge path 73*a* for discharging smaller tokens not to be used to the outside. This discharge member 73 is integrally provided on a maintenance cover 55*a* detachable from the gun main body 55. Thus, the smaller tokens not to be used are discharged to the outside via the discharge member 73.

A token detecting sensor 74 is mounted on a horizontally extending portion 57*y* of the facing member 57. The sensor 74 is comprised of a sensor member 74*a*, a mount member 74*b* and a reflection type optical sensor 74 provided on the sensor member 74*a*. This optical sensor 74*c* has its sensing direction oriented toward an opening 57*h* as shown in FIG. 10B and detects the insertion of the token 61.

A gunbarrel mount hole 57*e* is formed at a side (left side of FIG. 11) of the facing member 57, and a gunbarrel 75 is mounted in the gunbarrel mount hole 57*e* by a screw (not shown). The gunbarrel 75 includes two substantially rectangular guide plates 75*a*, 75*b*, and token guide groove forming members 75*c*, 75*d* having a substantially triangular shape and provided between the guide plates 75*a* and 75*b*. The lower surface of the upper forming member 75*c* and the upper surface of the lower forming member 75*d* are spaced apart by a distance L2 slightly longer than the diameter of the token 61 over the entire length thereof. The thickness of the forming members 75*c*, 75*d* is slightly larger than that of the token 61, and the muzzle 51 is defined between leading ends 75*c*' and 75*d*' of the forming members 75*c*, 75*d*. The lower forming member 75*d* has a substantially triangular shape whose width increases toward the side of the muzzle 51, whereas the upper forming member 75*c* has a substantially triangular shape whose width decreases toward the side of the muzzle 51. The gunbarrel 75 is mounted in the gunbarrel mount hole 57*e* with the two guide plates 75*a*, 75*b* made integral to each other by unillustrated screws or the like while holding the forming members 75*c*, 75*d* therebetween. A longitudinally long hollow (longitudinal hole) enclosed by the guide plates 75*a*, 75*b* and the forming members 75*c*, 75*d* substantially serves an interior of the gunbarrel for discharging the token.

Mount holes 57*f*, 57*g* are formed at a side (right side in FIG. 11) of the facing member 57, and a token push-out portion 76 is mounted in the mount holes 57*f*, 57*g*. The token push-out portion 76 includes a mount piece 76*a* to be mounted in the mount hole 57*g* and a vertical shaft 76*b* having its upper part supported on the mount piece 76*a* and having its lower part mounted in the mount hole 57*f*.

The token push-out portion 76 also includes a token push-out arm 76*c* having a pushing portion 76*d*, and a token pressing member 76*e*, and the token push-out arm 76*c* and the token pressing member 76*e* are integral to each other. This integral unit of the token push-out arm 76*c* and the token pressing member 76*e* is rotatably supported on the vertical shaft 76*b* with the vertical shaft 76*b* inserted through mount holes 76*i*, 76*j* formed in the token push-out arm 76*c* and with bushes 76*f*, 76*g* mounted in the mount holes 76*i*, 76*j* from the outside (see FIGS. 9A and 11). The token push-out arm 76*c* and the token pressing member 76*e* are provided at the outer side and the inner side of the facing member 57 with the facing member 58 therebetween (see FIG. 9B). A coil spring 76*h* for returning the token push-out arm 76*c* is provided between mounting pieces 76*k*, 76*m* in which the mount holes 76*i*, 76*j* are formed. The vertical shaft 76*b* is inserted through the inside of the coil spring 76*h*, and the opposite ends of the coil spring 76*h* projecting outward are held in contact with the token push-out arm 76*c* and the facing member 57 which are opposed to each other. The coil spring 76*h* biases a pushing force to the token push-out arm 76*c* in a direction of arrow E so that the token push-out arm 76*c* is brought closer to the facing member 57 (see FIG. 9B).

As shown in FIG. 9A, the token push-out arm 76*c* is provided with a suspending piece 76*n*, with which a bar 77*b* mounted on a hitting hammer 77*a* forming a token hitting portion 77 to be described later for dropping the token 61 can be brought into and out of contact. FIG. 9A shows a contact state while FIG. 12A shows a non-contact state.

Figure 14:
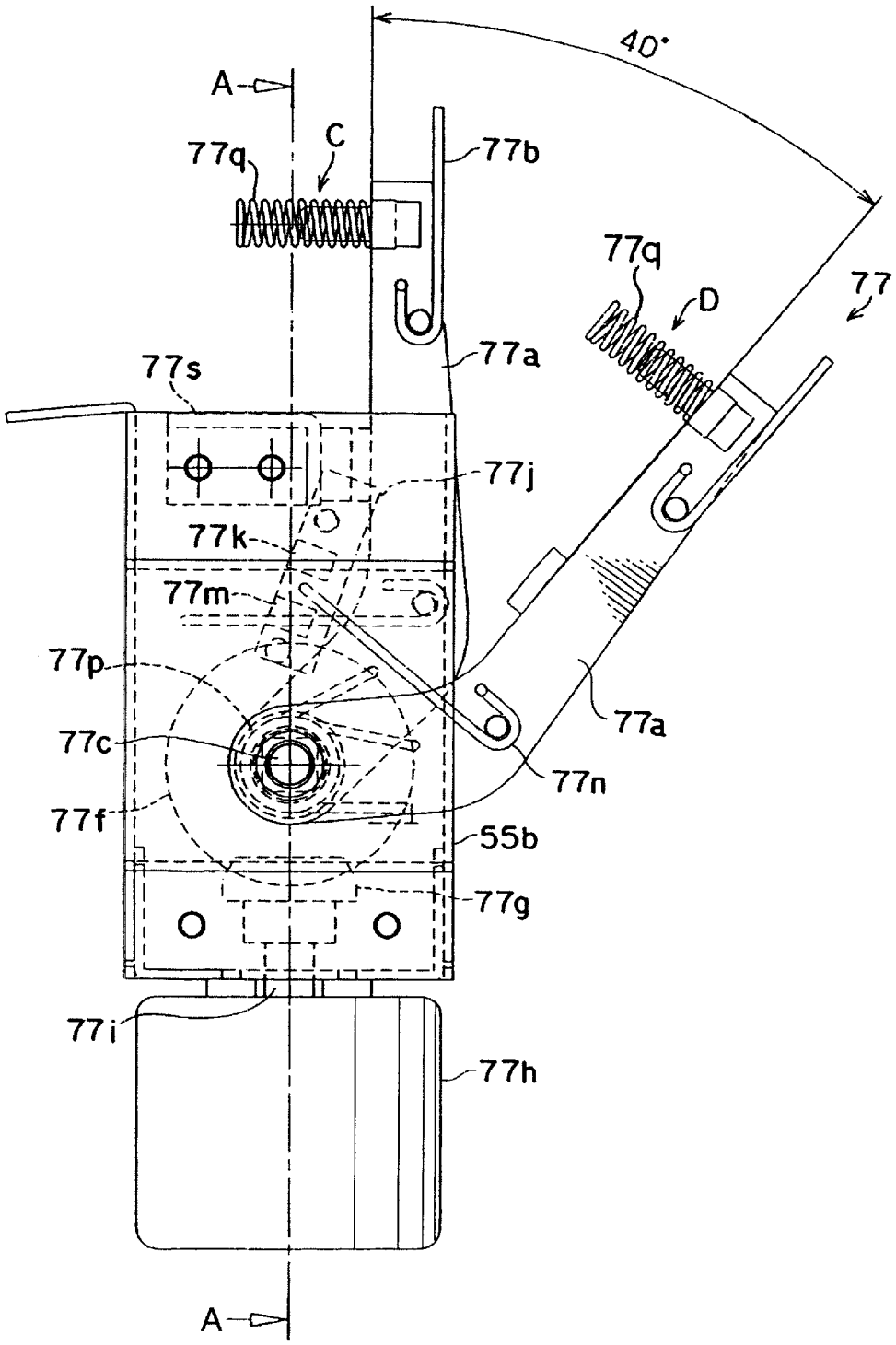
FIG. 14 is a front view showing a token hitting portion of the simulated gun provided in the shooting game machine of FIG. 1.

As shown in FIGS. 14 (front view) and 15 (left side view), the token hitting portion 77 includes a horizontal shaft 77*c* secured to the hitting hammer 77*a*, and the horizontal shaft 77*c* is rotatably supported on bearings 77*d*, 77*e* mounted on a lower frame 55*b* of the gun main body 55. A bevel gear 77*f* is secured to the horizontal shaft 77*c* and is engaged with another bevel gear 77*g*, which is secured to a rotatable shaft 77*i* of a rotary solenoid 77*h*.

Accordingly, as the rotatable shaft 77*i* of the rotary solenoid 77*h* rotates, the bevel gear 77*g* is rotated, which then causes the bevel gear 77*f* to rotate, thereby rotating the hitting hammer 77*a* to the right of FIG. 14 via the horizontal shaft 77*c* within a specified range. As a result, the hitting hammer 77*a* is retracted from a token hitting position C (corresponding to an advanced position).

Thereafter, an angle formed between a retracted position and the token hitting position C (advanced position) is, for example, 40°. Thereafter, the hitting hammer 77*a* is returned forward by the reverse rotation of the rotary solenoid 77*h*. The rotatable shaft 77*i* of the rotary solenoid 77*h* may be directly coupled to the horizontal shaft 77*c*. In the case of such a construction, the bevel gears 77*f* and 77*g* may be omitted.

A bar 77*n* is mounted on the hitting hammer 77*a*, and a photosensor 77*j* provided with a light emitter 77*k* and a light detector 77*m* is so provided as to face a rotatable range of the bar 77*n*.

Figure 15:
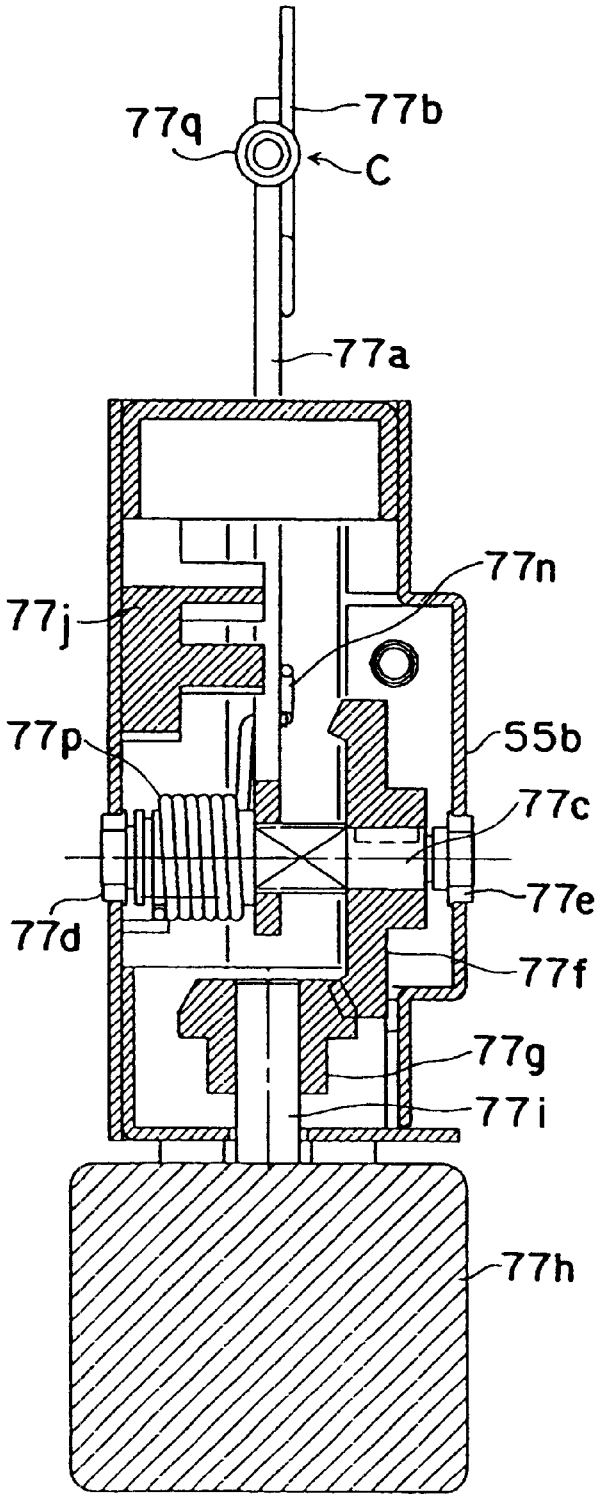
FIG. 15 is a left side view showing the token hitting portion of the simulated gun provided in the shooting game machine of FIG. 1, FIGS. 16A and 16B are perspective views showing a portion of a token push-out portion near a photosensor in the simulated gun provided in the shooting game machine of FIG. 1 when a bar is not detected and when it is detected, respectively.
Figure 16A:
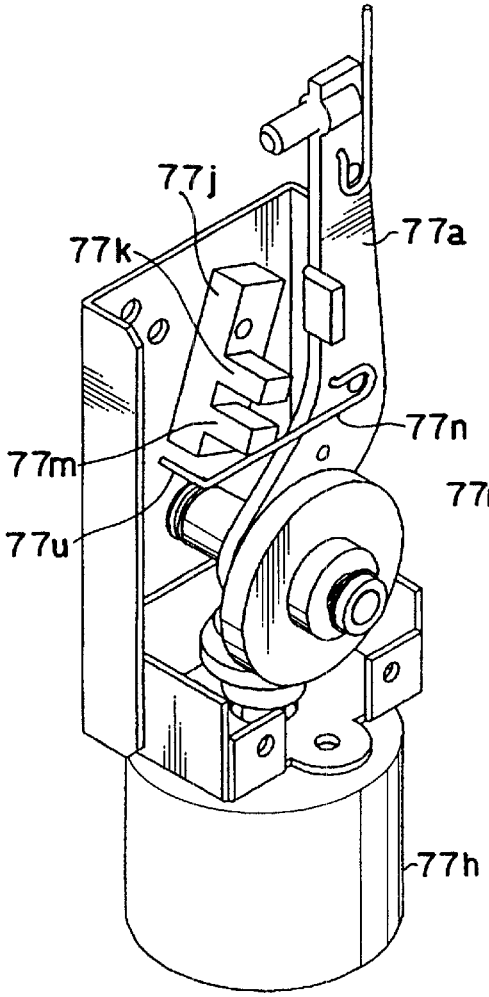
Figure 16B:
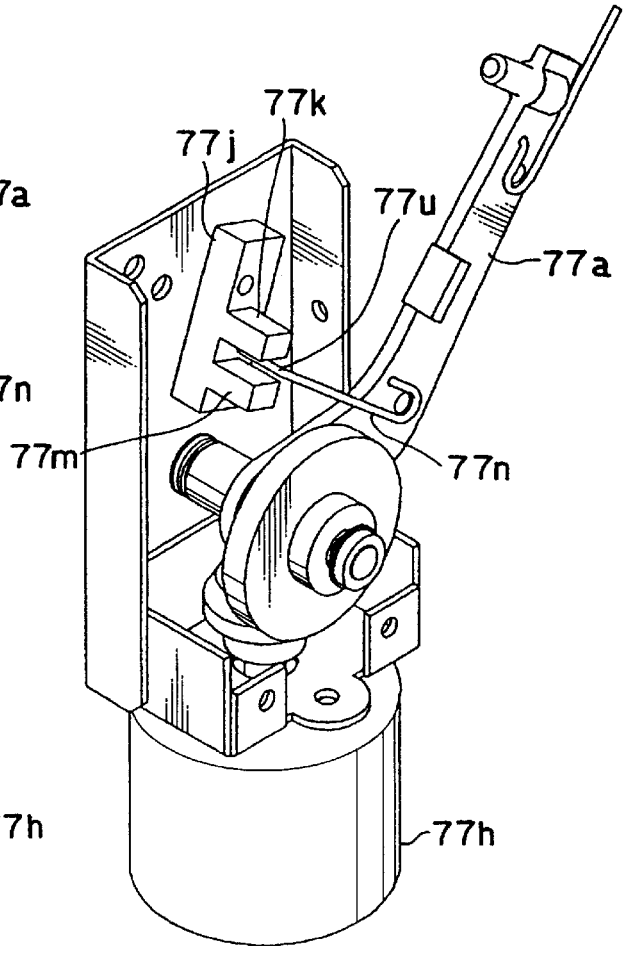

FIGS. 16A and 16B show a portion of the token push-out portion 77 near the photosensor 77*j* when the bar 77*n* is not detected and when the bar 77*n* is detected, respectively. When the hitting hammer 77*a* is retracted from the state of FIG. 16A to the state of FIG. 16B, a bent portion 77*u* at the leading end of the bar 77*n* crosses a sensing area of the light detector 77*m* and the photosensor 77*j* sends a return signal to a game controller 107 to be described later. The rotary solenoid 77*h* rotates in a direction reverse from the preceding forward direction in accordance with a signal from the game controller 107 to return the hitting hammer 77*a* forward. A coil spring 77*p* for returning the hitting hammer 77*a* forward is mounted on the horizontal shaft 77*c* as shown in FIGS. 14 and 15, and the hitting hammer 77*a* is returned forward by the rotation of the rotary solenoid 77*h* together with an elastic biasing force given from the coil spring 77*p*. Consequently, a hitting member mounted on the hitting hammer 77*a*, e.g. a coil spring 77*q* is returned from the retracted position D to the token hitting position C. Identified by 77*s* in FIG. 14 is a stopper for stopping the hitting hammer 77*a* near the token hitting position C.

Further, as the hitting hammer 77*a* is returned forward, the bar 77*b* is elastically deformed upon coming into contact with the suspending piece 76*c* as shown in FIG. 9A, and this elastic deforming force returns the token push-out arm 76*c* in a direction opposite from the arrow direction E against the pushing force acting in the arrow direction E. On the other hand, when the hitting hammer 77*a* is retracted by the rotary solenoid 77*h*, the bar 77*b* is brought out of contact with the suspending piece 76*n*. Accordingly, the token push-out arm 76*c* is rotated in the arrow direction E, and the pushing portion 76*d* passes through the opening 57*h* formed in the facing member 57 shown in FIGS. 10B and 11 to have its opposite sides held by the facing member 57 and the token pressing member 76*e* as shown in FIG. 10A, and pushes the token 61 placed on the stoppers 72*a*, 72*b* in a direction of arrow F (horizontal direction). Consequently, the token 61 is moved in the arrow direction F on the stoppers 72*a*, 72*b* and dropped from the ends of the stoppers 72*a*, 72*b* to be set in the token hitting position C.

The rotary solenoid 77*h* starts operating by pulling a trigger 78 provided in the gun main body 55 as shown in FIG. 6.

Figure 17B:
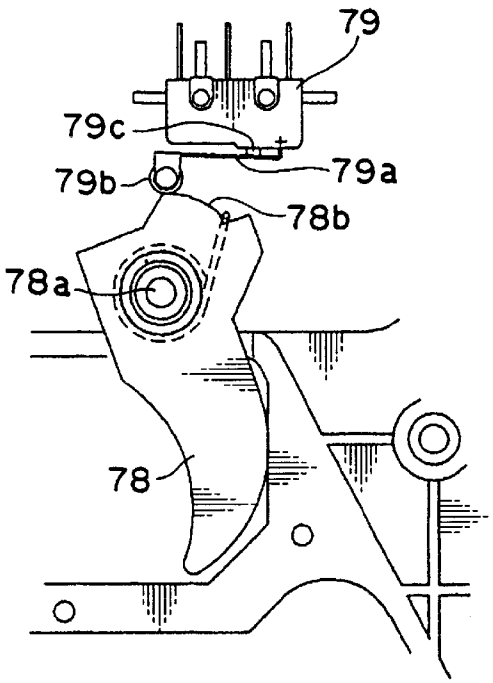
FIGS. 17A and 17B are front views showing a portion near a trigger of the simulated gun provided in the shooting game machine of FIG. 1 before the trigger is pulled and when it is pulled, respectively.
Figure 17A:
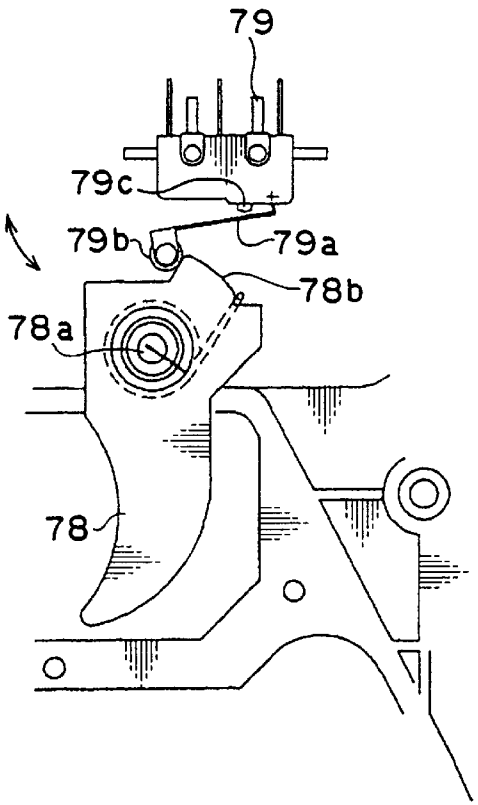

FIGS. 17A and 17B are front views showing a portion of the gun main body 55 near the trigger 78 before the trigger 78 is pulled and when it is pulled, respectively.

The trigger 78 is pivotal about a rotatable shaft 78*a*, and a cam portion 78*b* is formed at an upper part of the trigger 78. A microswitch 79 is provided above the trigger 78, such that a detector 79*a* of the microswitch 79 is pivotally provided in directions of arrows of FIG. 17A and a roller 79*b* provided at the leading end of the detector 79*a* is in sliding contact with the cam portion 78*b*. A switch portion 79*c* is provided near the detector 79*a* of the microswitch 79.

Before the trigger 78 is pulled, the detector 79*a* is away from the switch portion 79*c* as shown in FIG. 17A. When the trigger 78 is pulled, the detector 79*a* is pivoted upward by the cam portion 78*b* to push the switch portion 79*c* as shown in FIG. 17B, whereby the microswitch 79 detects that the trigger 78 has been pulled and outputs a detection signal to the game controller 107. The game controller 107 causes the rotary solenoid 77*h* to start operating in accordance with the received detection signal.

A gunsight 80 is provided on the top of the gun main body 55. The token 61 set in the token hitting position c is hit by the hitting member, e.g. the coil spring 77*q* when the game player pulls the trigger 78 while viewing through the gunsight 80. As a result, the token 61 is discharged from the muzzle 51 through the gunbarrel 75 to fly toward the target units 10, 20, 30. The coil spring 77*q* is provided to increase a force for hitting the token 61 since it can undergo such an elastic deformation as to elongate after being compressed. It should be noted that a leaf spring or the like may be used instead of the coil spring 77*q*.

Figure 18:
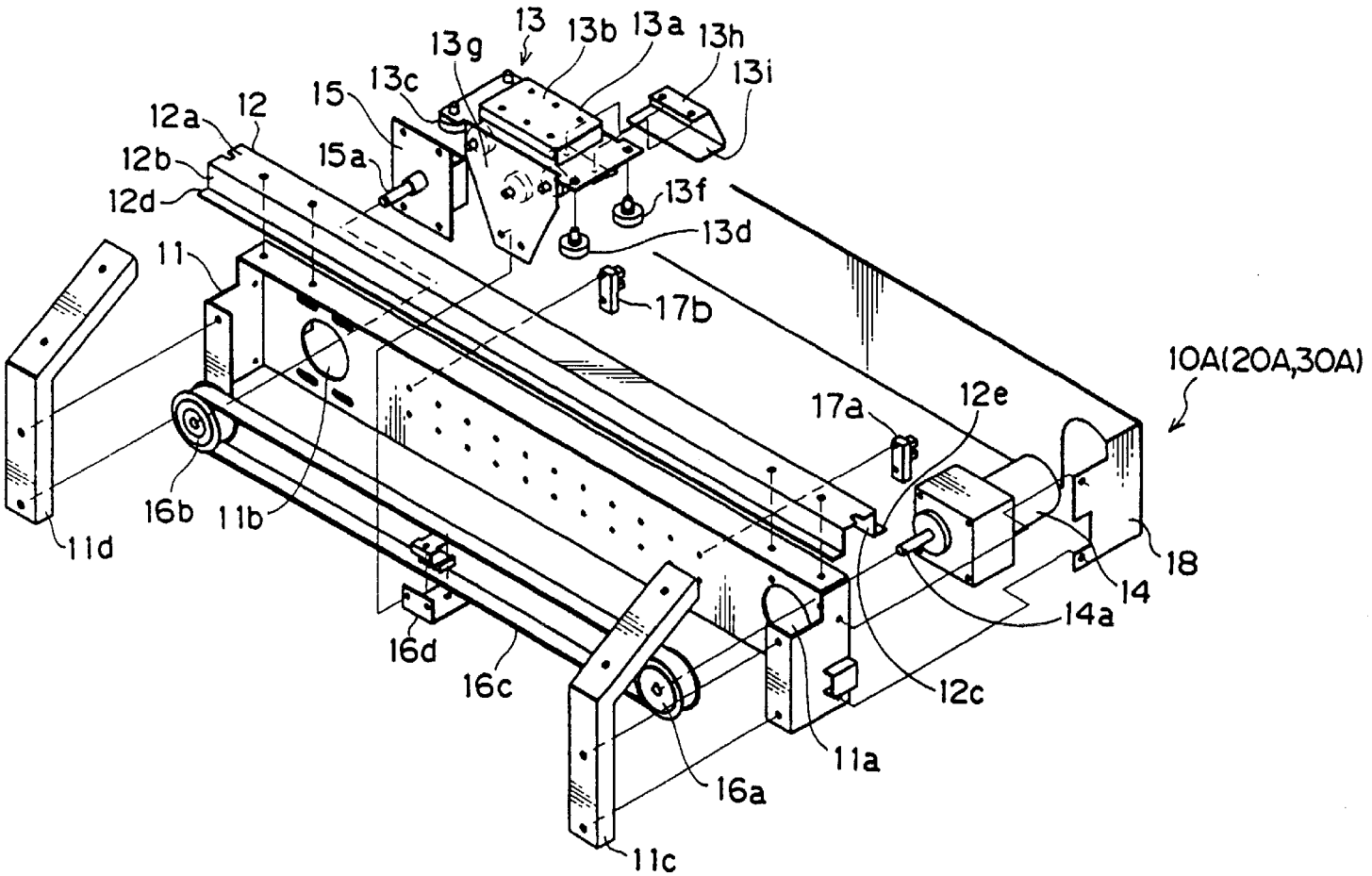
FIG. 18 is an exploded perspective view of a main unit provided in the shooting game machine of FIG. 1.
Figure 19:
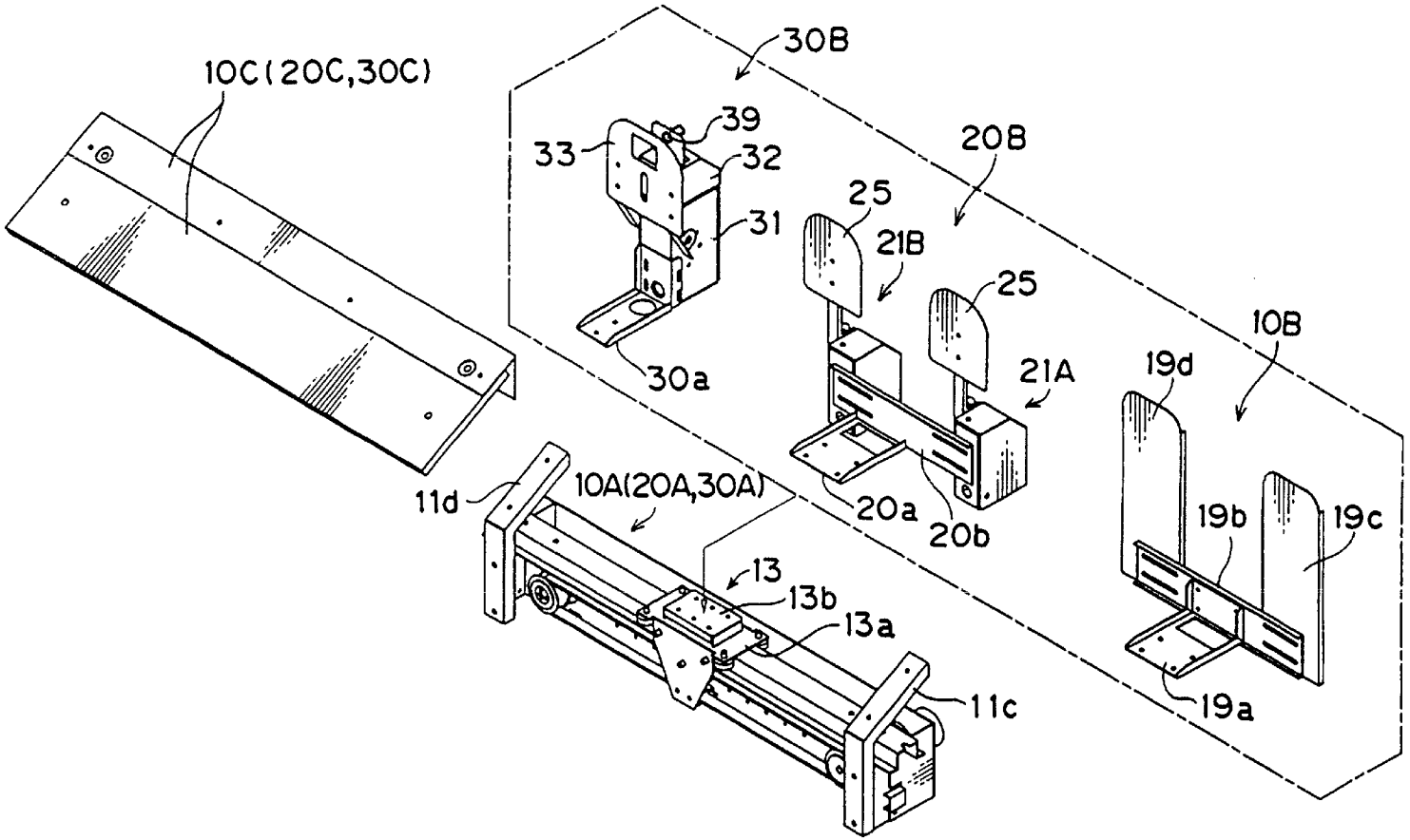
FIG. 19 is an exploded perspective view showing a construction of mounting interfering plates and target assemblies on the main unit and then mounting an identical cover.

The aforementioned screening portion 10 and target units 20, 30 are constructed by mounting different interfering plates 10A, 20A, 30B on identical main units 10A, 20A, 30A constructed as shown in FIG. 18 (exploded perspective view) and then mounting identical covers 10C, 20C, 30C as shown in FIG. 19. The screening portion 10 and the target units 20, 30 are described in detail below.

Figure 20A:
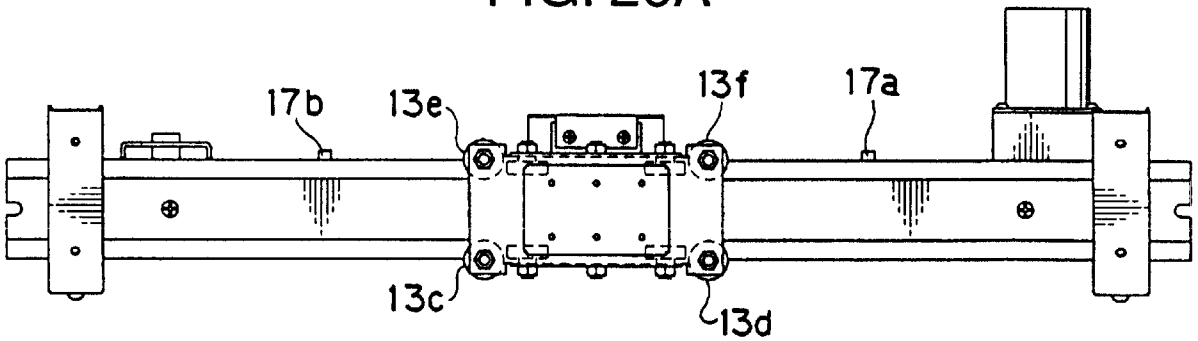
FIGS. 20A, 20B and 20C are a plan view, a front view and a left side view of the main unit shown in FIG. 18, respectively.
Figure 20B:
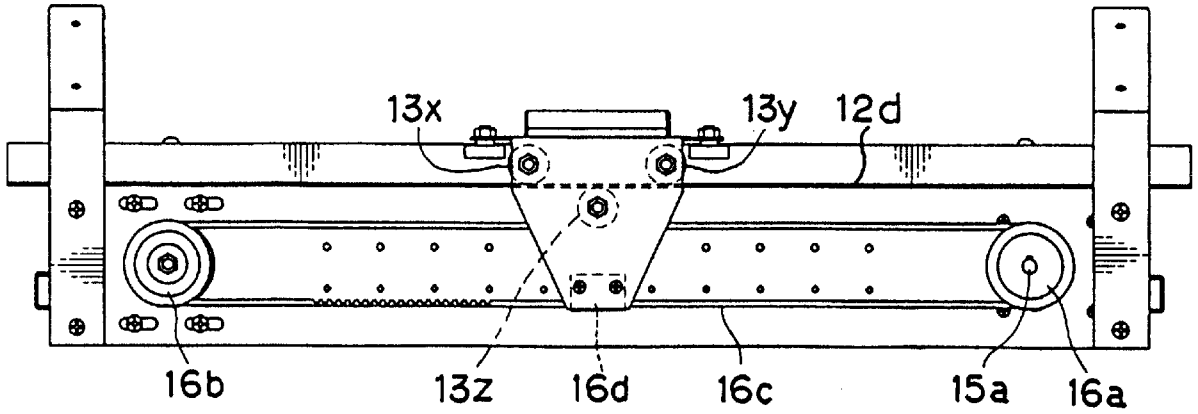
Figure 20C:
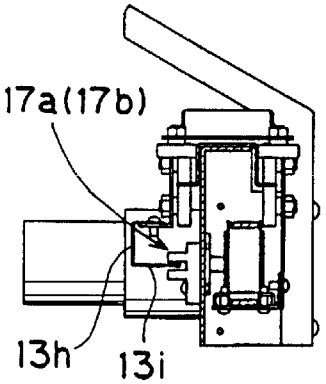
Figure 21:
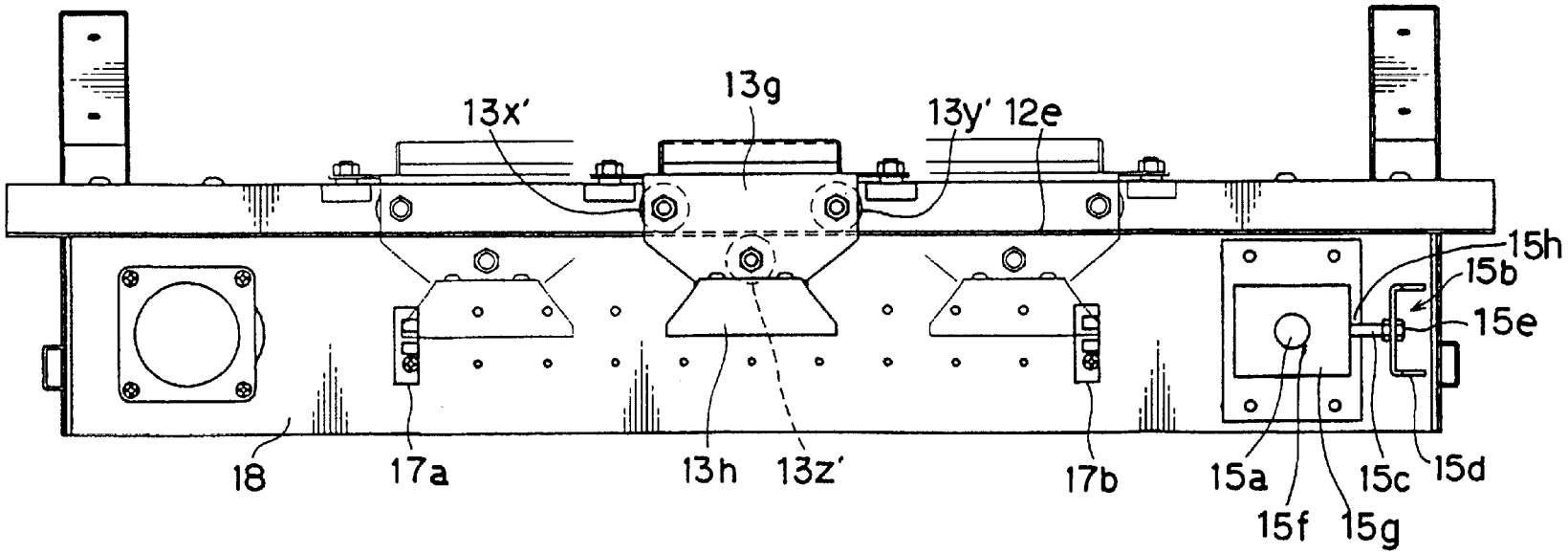
FIG. 21 is a rear view of the main unit shown in FIG. 18, FIGS. 22A and 22B are a front view and a right side view showing a target portion provided in the shooting game machine of FIG. 1, respectively.

FIGS. 20A, 20B and 20C are a plan view, a front view and a left side view of the main unit 10A (20A, 30A), respectively, and FIG. 21 is a rear view thereof.

As shown in FIG. 18, a guide rail 12 is mounted on a supporting plate 11 and a mounting portion 13 is movable on and along the guide rail 12 in the main unit 10A. The guide rail 12 includes flanges 12*d*, 12*e* projecting outwardly from the ends of opposite side surfaces 12*b*, 12*c* of a middle portion 12*a* having a U-shaped cross section.

The mounting portion 13 includes a mounting member 13*a* having a mounting surface 13*b* elevated like a table formed in its middle and having a substantially rectangular shape in plan view. Guide rollers 13*c*, 13*d*, 13*e*, 13*f* are mounted near the four corners of the mounting member 13*a*. The guide rollers 13*c*, 13*d* are in contact with the side surface 12*b* and the guide rollers 13*e*, 13*f* are in contact with the side surface 12*c* while the guide rail 12 is held between the guide rollers 13*c*, 13*d* and the guide rollers 13*e*, 13*f*. As shown in FIGS. 20B and 21, three guide rollers 13*x*, 13*y*, 13*z* are provided at the front side of the mounting portion 13, and three guide rollers 13*x*', 13*y*', 13*z*' are provided at the rear side thereof. The guide rollers 13*x*, 13*y*, 13*z* are so arranged as to hold the flange 12*d* therebetween, whereas the guide rollers 13*x*', 13*y*', 13*z*' are so arranged as to hold the flange 12*e* therebetween.

The supporting plate 11 is formed with round mount holes 11*a*, 11*b* at its opposite ends, and a motor 14 is mounted behind the mount hole 11*a* such that a rotatable shaft 14*a* thereof projects from the rear side to the front side of the mount hole 11*a*. On the other hand, a driven shaft member 15 is mounted behind the mount hole 11*b* such that a rotatable shaft 15*a* thereof projects from the rear side to the front side of the mount hole 11*b*. The driven shaft member 15 is provided with a tensioner 15*b* as shown in FIG. 21. The tensioner 15*b* is comprised of a supporting member 15*d* secured to a token entrance preventing cover 18 to be described later, a tensioning bolt 15*e* rotatably mounted on the supporting member 15*d*, a threaded bar 15*c* having one end mounted on the bolt 15*e*, an internally threaded portion 15*h* for allowing the passage of the other end of the threaded bar 15*c*, and a frame 15*g* formed with an internally threaded portion 15*f* for allowing the passage of an end of the shaft 15*a* of the driven shaft member 15. Thus, as the bolt 15*e* is rotated, the frame 15*g* and the shaft 15*a* are moved along transverse direction of FIG. 21.

A main drive pulley 16*a* is mounted on the rotatable shaft 14*a* of the motor 14, a driven pulley 16*b* is mounted on the shaft 15*a* of the driven shaft member 15, and an endless belt 16*c* is mounted on the pulleys 16*a*, 16*b* as shown in FIGS. 18 and 20. A fixed piece 16*d* is mounted on the endless belt 16*c*. This fixed piece 16*d* is fixed to a drive transmitting plate 13*g* mounted on the front surface of the mounting member 13*a*, and is moved along the guide rail 12 as the endless belt 16*c* rotates, with the result that the mounting member 13*a* is moved along the guide rail 12. A moving speed of the mounting member 13*a* is adjusted by the rotating speed of the motor 14, and a stretched degree of the endless belt 16*c* is adjusted by the rotation of the bolt 15*e*.

On the rear surface of the supporting plate 11, optical sensors 17*a*, 17*b* as two limit sensors are mounted while being spaced apart by a specified distance as shown in FIG. 21. Each optical sensor 17*a*, 17*b* is provided with a light emitter at one of its upper and lower sides and a light detector at the other of its upper and lower sides. On the other hand, a detectable member 13*h* having a U-shaped cross section is mounted on the rear surface of the mounting member 13*a* as shown in FIGS. 18 and 20C, and a lower horizontal piece 13*i* thereof is horizontally moved to pass between the light emitter and the light detector of the optical sensor 17*a* (17*b*). Both optical sensors 17*a*, 17*b* output a signal for switching the rotating direction of the motor 14 to a target movement controller 101 to be described later when light is blocked by the horizontal piece 13*i*, and the motor 14 rotates in either one of the forward and reverse directions in accordance with a signal from the target movement controller 101. In this way, the mounting member 13*a* reciprocates along the guide rail 12 within a specific range.

The token entrance preventing cover 18 is mounted on the rear surface of the supporting plate 11 as shown in FIGS. 18 and 21. On the other hand, cover mounting members 11*c*, 11*d* bent at obtuse angles are mounted on the front surface of the supporting plate 11 as shown in FIGS. 18 and 19.

The main unit 10A is constructed as above, and the other main units 20A, 30A are identically constructed.

The cover 10C (20C, 30C) is mounted on the cover mounting members 11*c*, 11*d* of the main unit 10A (20A, 30A). However, target raising members 29*a*, 29*b* to be described later and shown in FIG. 3 are mounted on the cover 30C.

In the main unit 10A, an interfering plate portion 10B is mounted on the mounting surface 13*b* of the mounting member 13*a* as shown in FIG. 19. The interfering plate portion 10*b* includes a supporting member 19*a* having an L-shaped cross section and mounted on the mounting surface 13*b*, an intermediate supporting member 19*b* fixed to a shorter side of the supporting member 19*a*, and interfering plates 19*c*, 19*d* fixed to the opposite ends of the intermediate supporting member 19*b*. Sheets having a desired picture or pattern are adhered to the interfering plates 19*c*, 19*d*.

In the main unit 20A, a target assembly 20B is mounted on the mounting surface 13*b* of the mounting member 13*a*. This target assembly 20B includes a supporting member 20*a* having an L-shaped cross section and mounted on the mounting surface 13*b*, an intermediate supporting member 20*b* fixed to a shorter side of the supporting member 20*a*, and target portions 21A, 21B fixed to the opposite ends of the intermediate supporting member 20*b*. The target portions 21A, 21B are identically constructed.

Figure 22B:
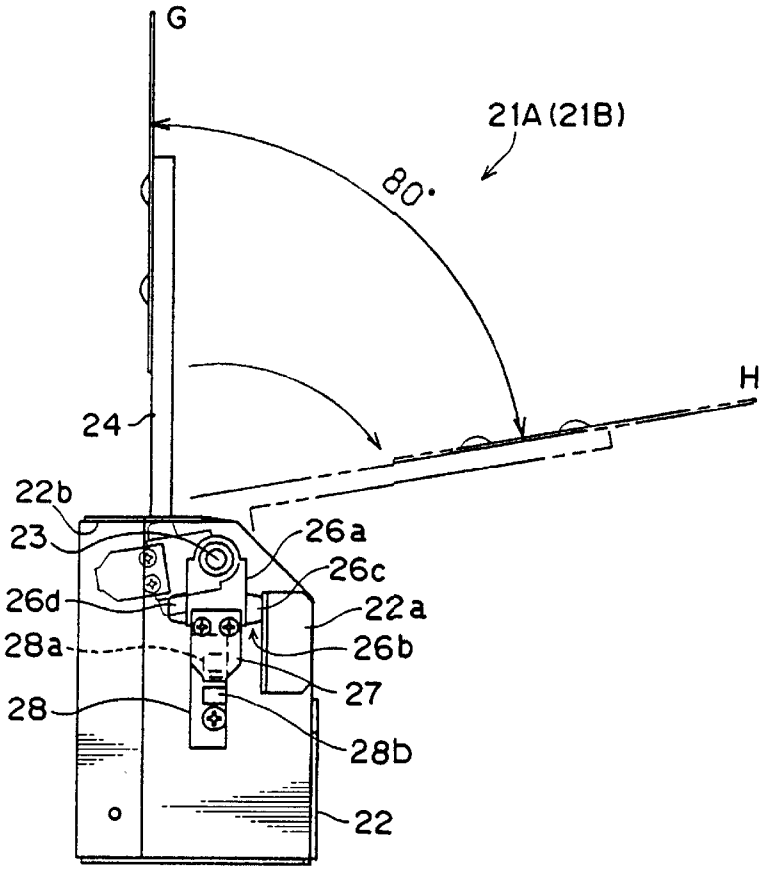
Figure 22A:
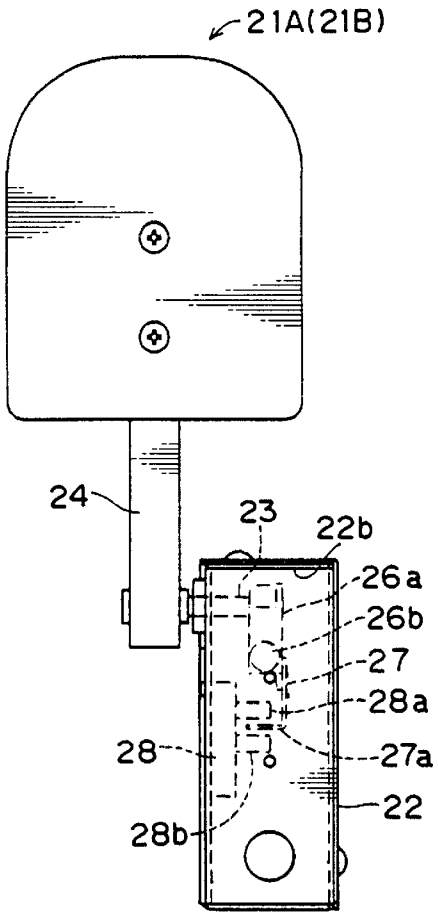

FIGS. 22A and 22B are a front view and a right side view showing the target portion 21A (21B), respectively.

The target portion 21A includes a supporting box 22, a target mounting piece 24 which is rotatably mounted on a support shaft 23 provided on the supporting box 22 between a standing position G and a laying position H reached when being rotated backward from the standing position G, and a plate-shaped target 25 fixed to the mounting piece 24. A sheet having a desired picture or pattern is adhered to the target 25. A fixed member 26*a* is fixed to the support shaft 23, and a substantially cylindrical stopper 26*b* is mounted on the fixed member 26*a* in a direction normal to a radial direction of the support shaft 23 while opposite ends 26*c*, 26*d* thereof project from an edge of the fixed member 26*a*. When the mounting piece 24 and the target 25 are at the standing position G, one end 26*c* of the stopper 26*b* is in contact with a stopping member 22*a* provided in the supporting box 22. When the mounting piece 24 and the target 25 are at the laying position H, an other end 26*d* of the stopper 26*b* is in contact with a ceiling surface 22*b* of the support box 22.

A light blocking member 27 having an L-shaped cross section is mounted on the fixed member 26*a*, and an optical sensor 28 is provided in a rotatable range of a bent light blocking portion 27*a* at the outer side of the light blocking member 27. In the optical sensor 28, a light emitter 28*a* and a light detector 28*b* are spaced apart by a specified distance in vertical direction, and the light blocking portion 27*a* passes between the light emitter 28*a* and the light detector 28*b*. When the state of the optical sensor 28 changes from the one where light which should be incident on the light detector 28*b* is blocked by the light blocking portion 27*a* to the one where light is incident on the light detector 28*b*, the optical sensor 28 outputs a signal representing that the token 61 has hit the target 25 to a token hit processing mode controller 110 to be described later upon judgment that the target 25 is moving from the standing position G to the laying position H.

The target 25 fallen down by being hit by the token 61 is returned to the standing position G by the target raising member 29*a* when the mounting member 13*a* is moved outwardly along the guide rail 12. More specifically, as shown in FIGS. 3 and 4, the edge of the fallen target 25 of the target portion 21A comes into contact with a slanted portion 29*c* of the target raising member 29*a* while the target 25 is moved in direction G, and the target 25 is thereby gradually raised and returned to the standing position G upon reaching a horizontal portion 29*d*.

The above applies also to the target portion 21B except that the target 25 of the target portion 21B is returned from the laying position H to the standing position G by the other target raising member 29*b*. Specifically, the edge of the fallen target 25 of the target portion 21B comes into contact with a slanted portion 29*e* of the target raising member 29*b* while the target 25 is moved in direction G, and the target 25 is thereby gradually raised and returned to the standing position G upon reaching a horizontal portion 29*f*.

In the main unit 30A, the target assembly 30B is mounted on the mounting surface 13*b* of the mounting member 13*a* as shown in FIG. 19. The target assembly 30B includes a supporting member 30*a* having an L-shaped cross section and mounted on the mounting surface 13*b*, a lower box 31 fixed to a shorter side of the supporting member 30*a*, an upper box 32, a plate-shaped target 33 rotatably mounted on the lower box 31, and a light source (one lamp 39 in the shown example) provided on the upper box 32. It should be noted that a plurality of lamps 39 may be provided as a light source.

Figure 23B:
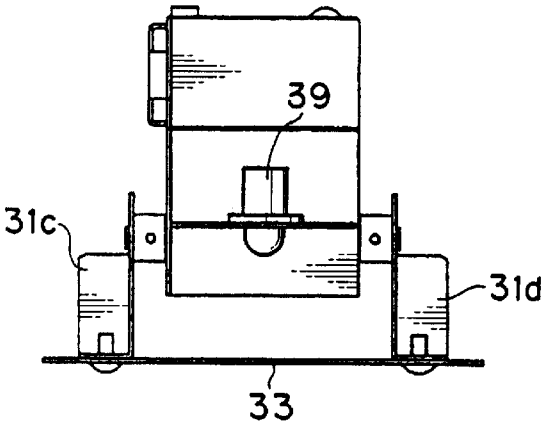
FIGS. 23A and 23B are a front view and a plan view showing the target assembly (without a supporting member) provided in the shooting game machine of FIG. 1, respectively.
Figure 23A:
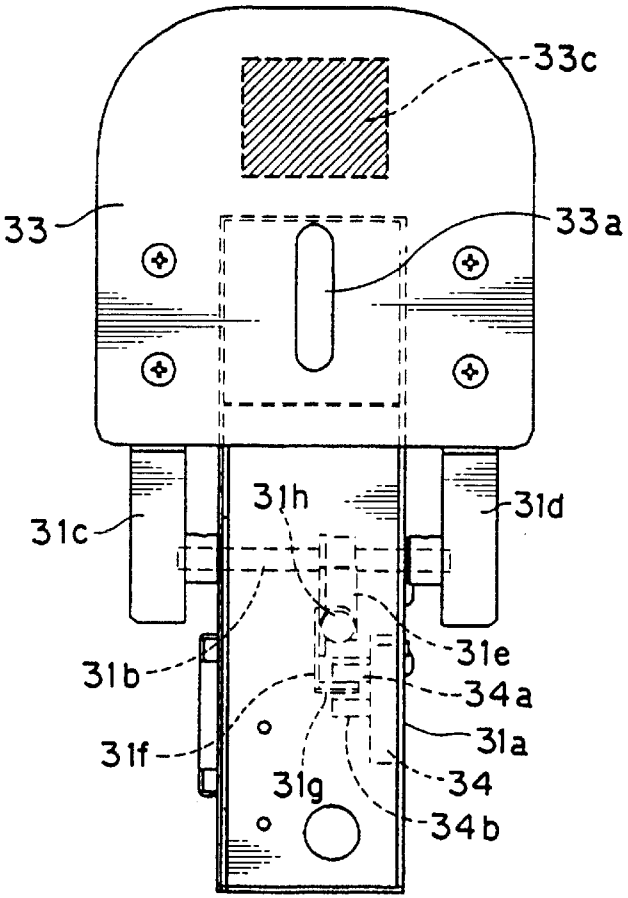
Figure 24B:
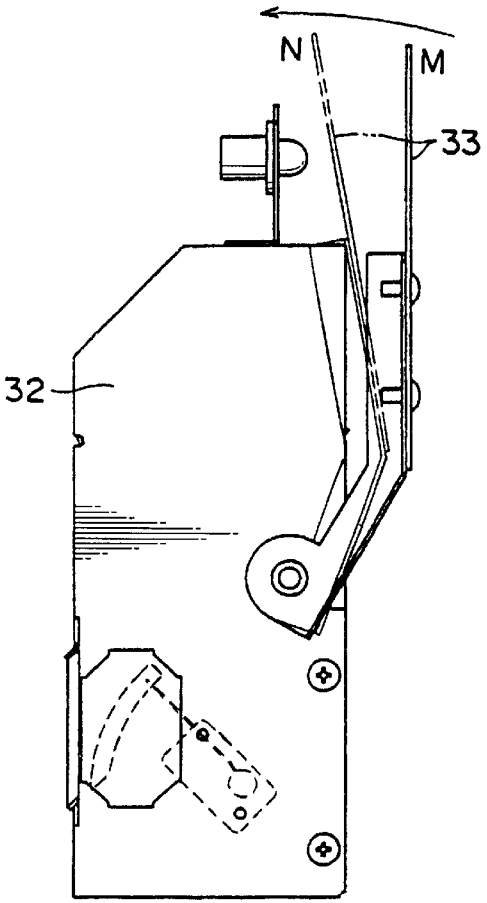
FIGS. 24A and 24B are a rear view and a left side view showing the target assembly (without the supporting member) provided in the shooting game machine of FIG. 1, respectively.
Figure 24A:
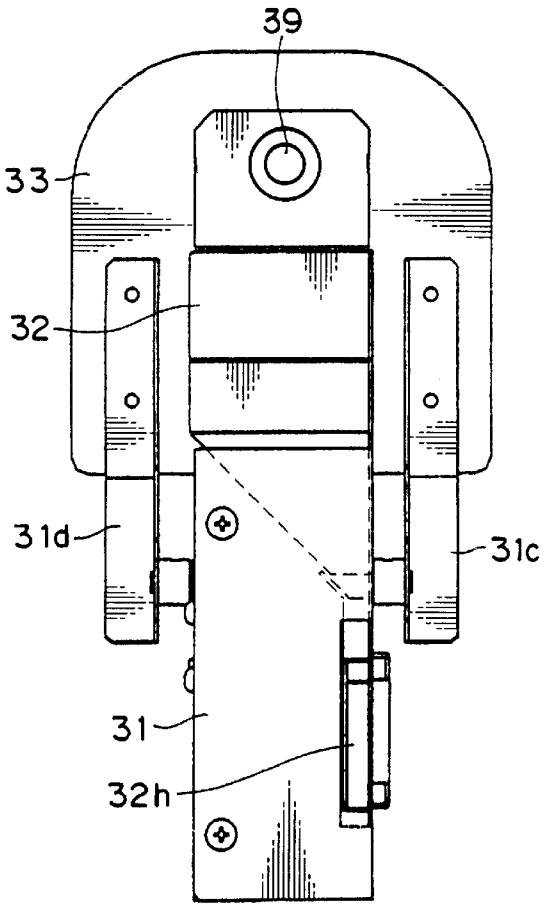
Figure 25A:
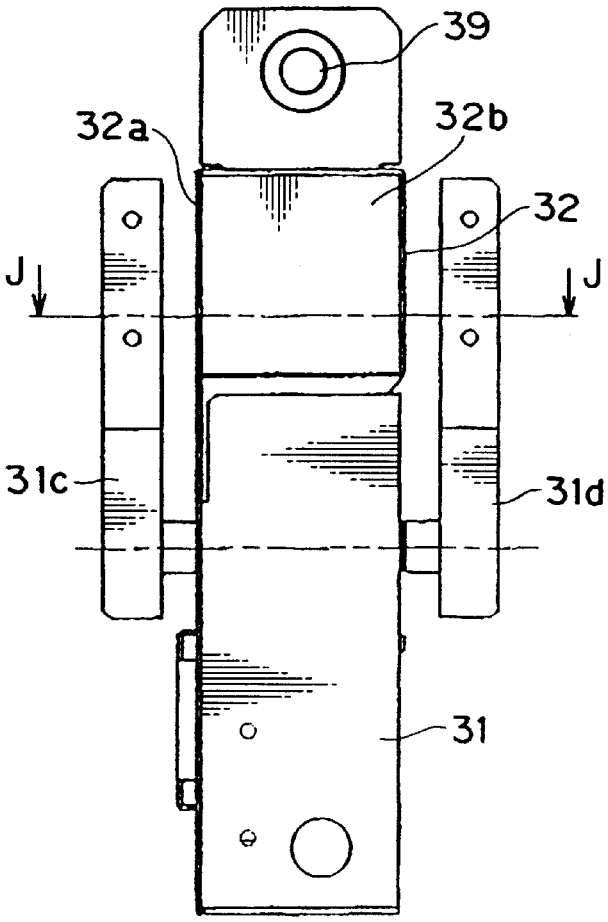
FIGS. 25A and 25B are a front view showing the target assembly (without the supporting member and a target) provided in the shooting game machine of FIG. 1 and a section along J—J of FIG. 25A, respectively.
Figure 25B:
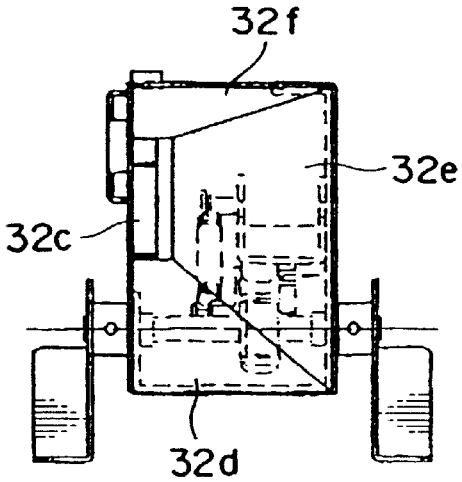

FIGS. 23A and 23B are a front view and a plan view showing the target assembly 30B (without the supporting member 30*a*) provided in the shooting game machine of FIG. 1; FIGS. 24A and 24B are a rear view and a left side view showing the target assembly 30B; FIGS. 25A and 25B are a front view showing the target assembly 30B (without the supporting member 30*a* and the target 33) and a section along J—J of FIG. 25A; and FIGS. 26A and 26B are a left side view in section showing the internal construction of the lower box 31 and a right side view in section showing the internal construction of the upper box 32.

As shown in FIG. 23A, the lower box 31 includes a support shaft 31*b* rotatably supported on a frame 31*a*, and the opposite ends of the support shaft 31*b* project out from the frame 31*a* and supporting pieces 31*c*, 31*d* are mounted on the projecting ends of the support shaft 31*b*. The target 33 is mounted on the supporting pieces 31*c*, 31*d* and is formed with a jackpot 33 which is an oblong hole and a rectangular opening 33*b*. A meshed resin film (shown by hatching) 33*c* for transmitting a light from the lamp 39 is mounted in the opening 33*b*. An unillustrated sheet having a desired picture or pattern is adhered to the front surface of the target 33. This sheet is formed with openings corresponding to the jackpot 33*a* and the opening 33*b*.

Figure 26B:
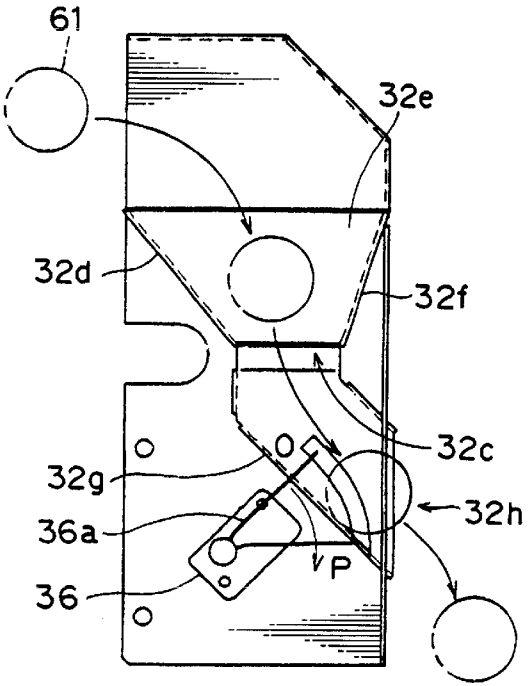
FIGS. 26A and 26B are a left side view in section showing the internal construction of a lower box provided in the shooting game machine of FIG. 1 and a right side view in section showing the internal construction of an upper box provided in the shooting game machine of FIG. 1, respectively.
Figure 26A:
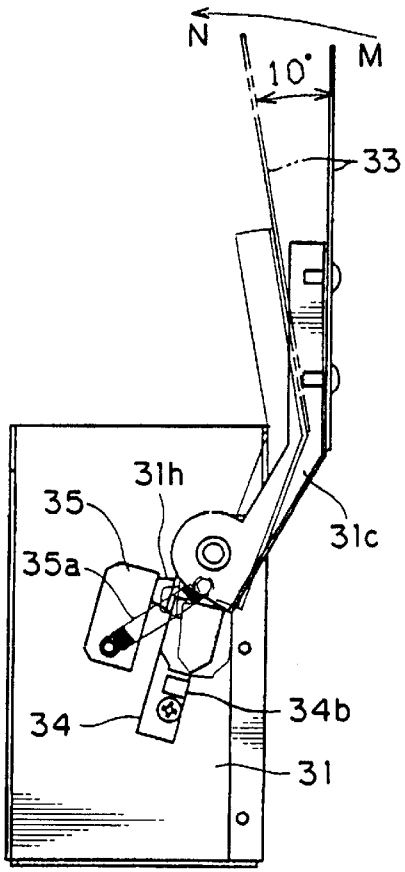

A spring 35*a* having one end thereof mounted on a spring bracket 35 has the other end thereof mounted on the supporting piece 31*c* as shown in FIG. 26B, and the target 33 is held in a standing position M by a pulling biasing force of the spring 35*a* and is fallen back to a laying position N when the token hits the target 33. A fixed member 31*e* is fixed to the support shaft 31*b* (see FIG. 23A), a stopper 31*h* substantially in the form of a truncated cone is mounted on this fixed member 31*e* and comes into contact with the spring bracket 35. While the stopper 31*h* is held in contact with the spring bracket 35, the target 33 is held in the laying position N.

A light blocking member 31*f* having an L-shaped cross section is mounted on the fixed member 31*e* as shown in FIG. 23A, and an optical sensor 34 is provided in a rotatable range of a bent light blocking portion 31*g* at the outer side of the light blocking member 31*f*. In the optical sensor 34, a light emitter 34*a* and a light detector 34*b* are spaced apart by a specified distance in vertical direction, and the light blocking portion 31*g* passes between the light emitter 34*a* and the light detector 34*b*. When the state of the optical sensor 34 changes from the one where light which should be incident on the light detector 34*b* is blocked by the light blocking portion 31*g* to the one where light is incident on the light detector 34*b*, the optical sensor 34 outputs a signal representing that the token 61 has hit the target 25 to the token hit processing mode controller 110 upon judgment that the target 33 is moving from the standing position M to the laying position N.

The jackpot 33*a* is formed in the target 33 to allow the passage of the token 61 having hit it. A wide rectangular opening 32*b* formed in an upper part of the frame 32*a* of the upper box 32 is located behind the jackpot 33*a*, so that the token 61 having passed through the jackpot 33*a* enters the frame 32*a* of the upper box 32 through the opening 32*b*.

Inside the frame 32*a*, three slanted plates 32*d*, 32*e*, 32*f* are provided toward the bottom where a dropping hole 32*c* is formed, so that the token 61 having entered the frame 32*a* is guided to the dropping hole 32*c* by the slanted plates 32*d*, 32*e*, 32*f*. The slanted plates 32*d*, 32*e*, 32*f* are located above the spring bracket 35, the spring 35*a*, etc. provided in the lower box 31.

As shown in FIG. 26B, a pipe 32*g* for discharging the token 61 is provided below the dropping hole 32*c*, and a detector 36*a* of a microswitch 36 is so provided in an intermediate position of the pipe 32*g* as to project inside the pipe 32*g*. An outlet of the pipe 32*g* serves as a discharge port 32*h*. While falling down by being guided by the pipe 32*g*, the token 61 displaces the detector 36*a* from a non-detecting state O to a detecting state P. As the detector 36*a* is displaced, the microswitch 36 detects the entrance of the token 61 into the oblong hole 33*a* of the target mounting plate 33 and outputs a detection signal to the token hit processing mode controller 110.

Thereafter, the token 61 is discharged through the discharge port 32*h* shown in FIGS. 24A and 26B and collected into a token collecting box 82 by a slanted plate 81 shown in FIG. 4.

Figure 27:
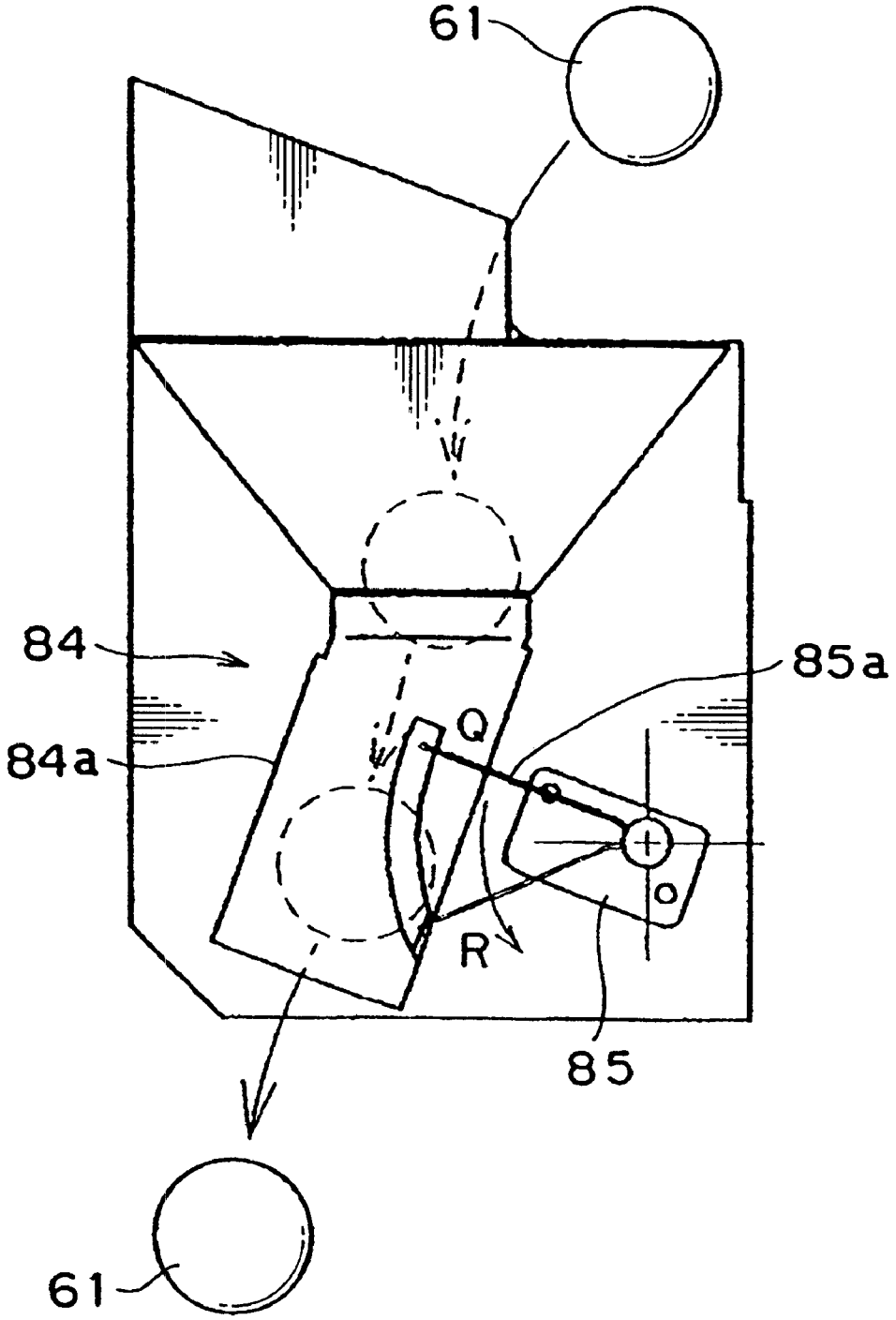
FIG. 27 is a section showing a token detecting section of the lower box provided in the shooting game machine of FIG. 1.

The slanted plate 81 guides the tokens 61 to the token collecting box 82 except those having hit the interfering plates 19*c*, 19*d*. The tokens 61 having hit the interfering plates 19*c*, 19*d* are guided by slanted plates 83*a* and 83*b* provided at the front bottom side of the cover 10C to a dropping hole 83*c* formed between the slanted plates 83*a* and 83*b* (see FIG. 4). A token detecting device 84 shown in FIGS. 4 and 27 is provided below the dropping hole 83*c*.

The token detecting device 84 has a pipe 84*a* for guiding the token 61, and a detector 85*a* of a microswitch 85 is so provided in an intermediate position of the pipe 84*a* as to project into the pipe 84*a*. While falling down by being guided by the pipe 84*a*, the token 61 displaces the detector 85*a* from a non-detecting state Q to a detecting state R. As the detector 85*a* is displaced, the microswitch 85 detects that the token 61 has been sprung back by being interfered by the interfering plate 19*c* or 19*d*, and outputs a detection signal to a control unit 100.

Thereafter, the token 61 is collected into the token collecting box 82 by the slanted plate 81. In this embodiment, the moving speed of the interfering plates 19*c*, 19*d*, that of the targets 25 and that of the target 33 along the longitudinal direction of the guide rails 12 (transverse direction when viewed from the game player) are adjusted by the rotating speed of the motor 14 and are so set as to differ from each other. An adjustment of the relative positions of the interfering plates 19*c*, 19*d*, the targets 25 and the target 33 can be made by adjusting the positions of the optical sensors 17*a*, 17*b* as limit sensors.

Figure 28:
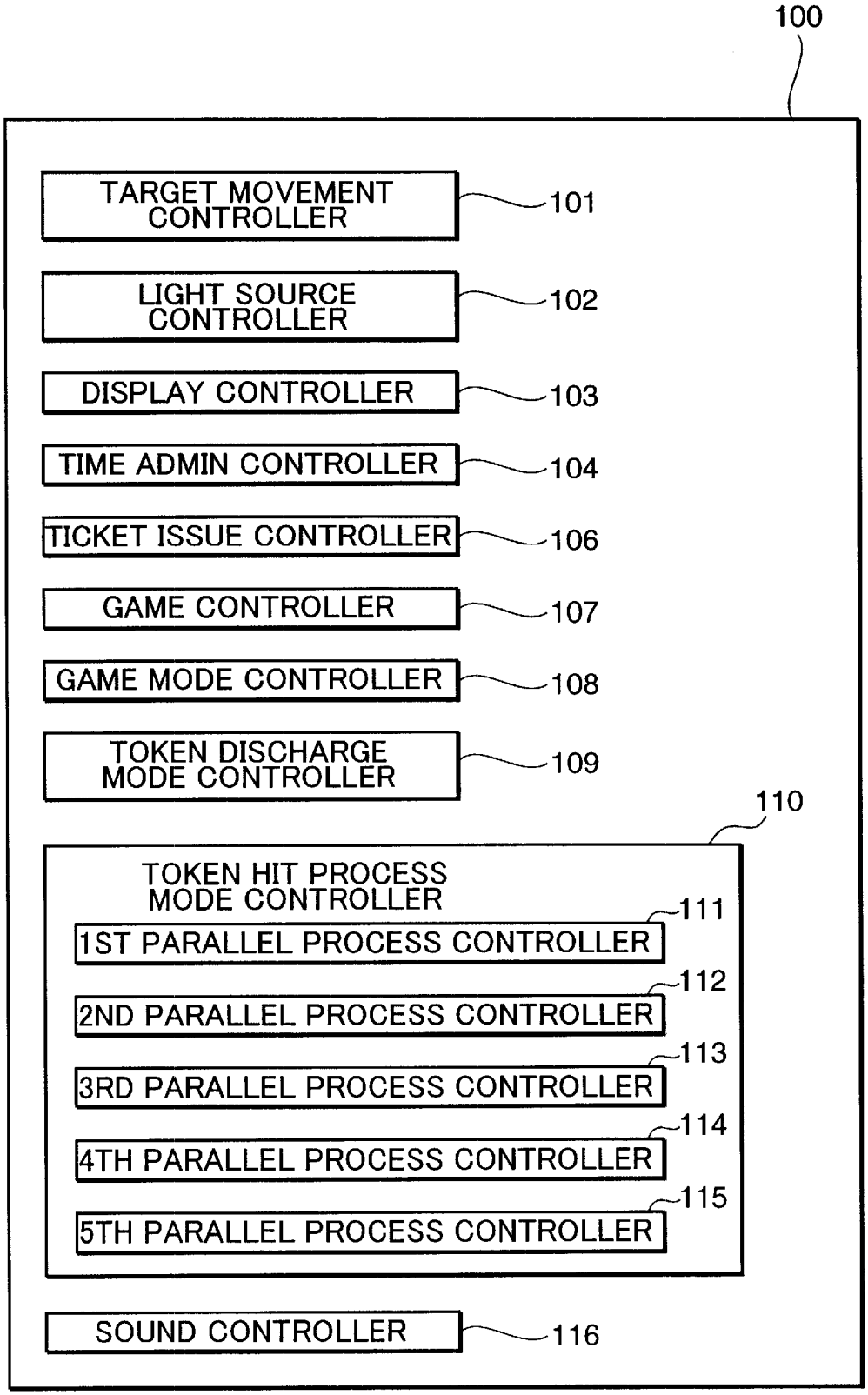
FIG. 28 is a block diagram showing the construction of a control unit provided in the shooting game machine of FIG. 1.

FIG. 28 is a block diagram showing the construction of the control unit 100.

The control unit 100 is provided with the target movement controller 101 for controlling the movements of the targets, a light source controller 102 for controllably turning the light source on and off, a display controller 103 for controlling a displayed state of a display device, a time administration controller 104 for executing time administration of the respective elements in accordance with a timer signal, a ticket issuance controller 106, the game controller 107 for controlling the entire shooting game machine, a game mode controller 108 for controlling a game mode upon entering it, a token discharge mode controller 109 for controlling a token discharge processing mode upon entering it, the token hit processing mode controller 110 for controlling a token hit processing mode upon entering it, first to fifth parallel processing controllers 111, 112, 113, 114, 115 and a sound controller 116.

The control unit 100 is provided with a CPU system and controls the respective elements of the shooting game machine 1 as the shooting game machine 1 is turned on and of f and the operations of the respective controllers 101 to 104, 106 to 116.

The target movement controller 101 is provided with a CPU system, controls the operations of the respective targets upon receiving a command from the control unit 100 or a signal from a proximity sensor 8 and controllably rotates the motor 14 in forward and reverse directions in accordance with signals from the optical sensors 17*a*, 17*b* as limit sensors.

The light source controller 102 is provided with a CPU system and controllably turns the light sources 17*a* to 17*d* and the lamp 39 on and off in accordance with a command from the control unit 100 or the token hit processing mode controller 110. The sound controller 116 controls a sound output of the loudspeaker 8A.

The display controller 103 displays a specified score on the display device upon receiving a signal concerning the score from the token hit processing mode controller 110. For example, every time shooting is made, points correspond to the hit target are displayed on the display device 6*a* with 0 as an initial value. After the initial value becomes 100 upon hitting the jackpot 33*a*, a jackpot value which is a total of points added to the initial value 100 is displayed on the display device 6*b* every time shooting is made until the jackpot is hit next time.

The time administration controller 104 executes time administration for the respective elements in accordance with timer signals from the specified CPU systems. For example, the controller 104 executes a specified time administration in according with a signal from the optical sensor, a signal from the microswitch 79, a signal from the photosensor 77*j* or a like signal. The administered time data is read by the token hit processing mode controller 110.

The ticket issuance controller 106 discharges a specified number of tickets each representing, for example, 1 point through the ticket discharge opening 9 according to the score given by the token hit processing mode controller 110.

The game controller 107 controls the entire shooting game machine 1. For instance, the game controller 107 controllably rotates the rotary solenoid 77*h* in forward direction upon receiving the detection signal from the microswitch 79 or in reverse direction upon receiving the detection signal from the photosensor 77*j*. Further, the game controller 107 gives an operation starting command to the game mode controller 108 upon entering the game mode to be described later, also to the token discharge mode controller 109 upon entering the token discharge mode, and also to the token hit processing mode controller 110 upon entering the token hit processing mode.

The game mode controller 108, the token discharge mode controller 109, the token hit processing mode controller 110, and the first to fourth parallel processing controllers 111 to 115 are each provided with the CPU system and execute specified processings in accordance with control programs shown in FIGS. 29 to 35 set for the respective controllers 108 to 115.

The token hit processing mode controller 110 receives contents of processings from the first to fifth parallel processing controllers 111 to 115, changes and sets an order of processings of the respective parallel processing controllers 111 to 115. Further, the token hit processing mode controller 110 detects that the token 61 has hit the target 25 in accordance with a signal from the optical sensor 28, outputs a signal concerning points to be given (5 points) to the display controller 103, which in turn displays the points (5 points) on the display device 6*a* while displaying a value obtained by adding these points to the current jackpot value on the display device 6*b*.

Further, the token hit processing mode controller 110 detects that the token 61 has hit the target 33 in accordance with a signal from the optical sensor 34, and outputs a signal concerning points to be given (10 points) to the display controller 103, which in turn displays the points (10 points) on the display device 6*a* while displaying a value obtained by adding these points to the current jackpot value on the display device 6*b*.

Further, the token hit processing mode controller 110 detects that the token 61 has hit the jackpot 33*a* in accordance with a signal from the microswitch 36, and outputs a specified signal to the display controller 103, which in turn displays the same points as the score displayed on the display device 6*b* at this time on the display device 6*a* while displaying an initial value 100 on the display device 6*b*.

Further, the token hit processing mode controller 110 detects that the token 61 has been directly dropped onto the slanted plate 81 without hitting either the target 25, 33 or the jackpot 33*a* after passing the interfering plates 19*c*, 19*d* when no signal is inputted from the optical sensors 28, 34, the microswitch 34 and the microswitch 85 even after the lapse of, e.g. 1.5 sec. following the discharge of the token 61, and outputs a signal concerning points to be given (2 points) to the display controller 103, which in turn displays the points (2 points) on the display device 6*a* while displaying a value obtained by adding these points to the current jackpot value on the display device 6*b*.

Next, contents of the operation of the shooting game machine thus constructed are described with reference to FIGS. 29 to 35.

Figure 29:
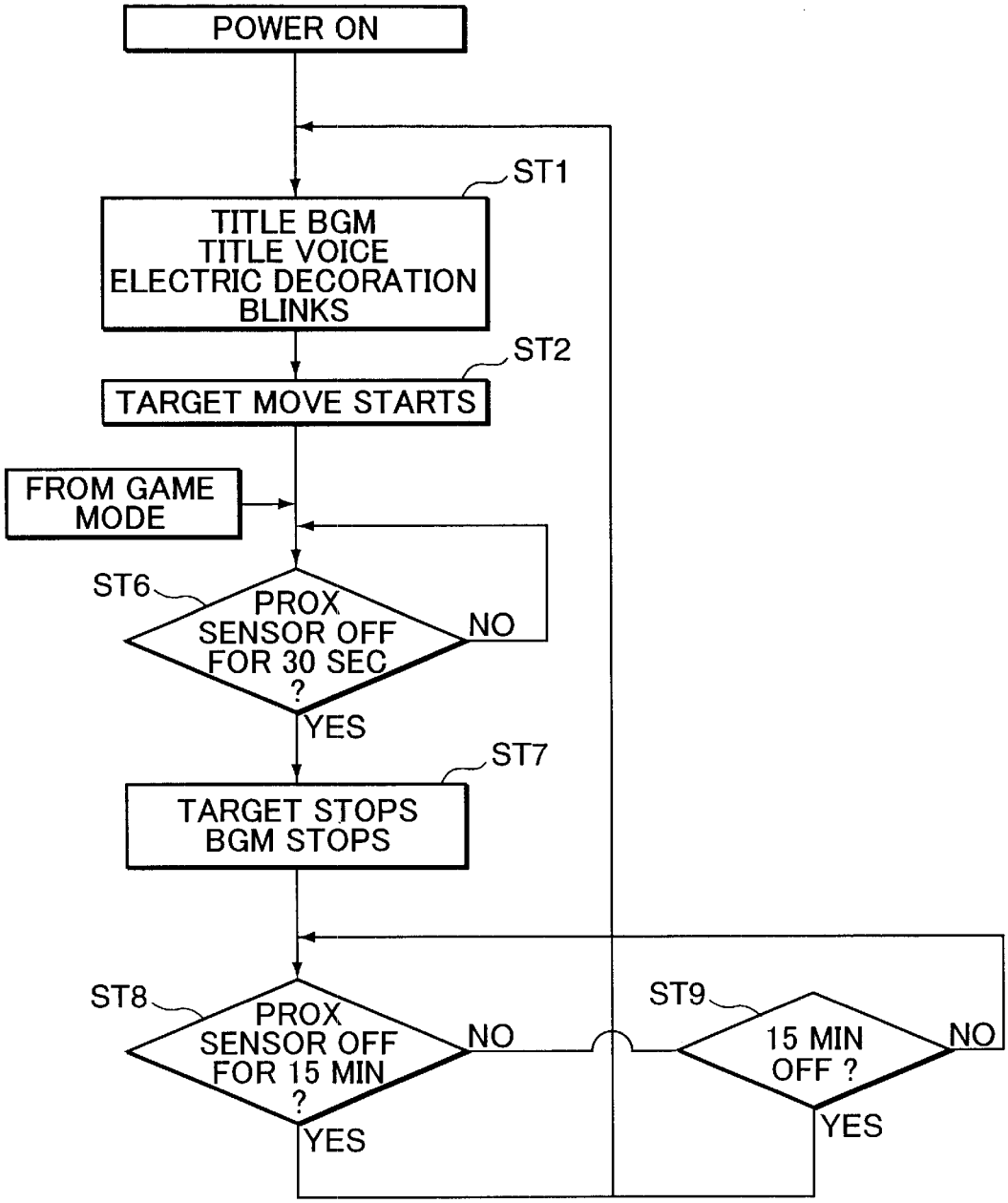
FIG. 29 is a flow chart showing a demonstration mode control executed in the shooting game machine of FIG. 1.

First, as shown in FIG. 29, when the shooting game machine is turned on to start the operation, a demonstration mode is started by a command from the game controller 107 and a BGM (background music) and sounds in conformity with the title are outputted by the loudspeaker 8A and the lamps 7*a* as electric decorations are blinked (Step ST1). Subsequently, a target moving mode is started (Step ST2).

Figure 31:
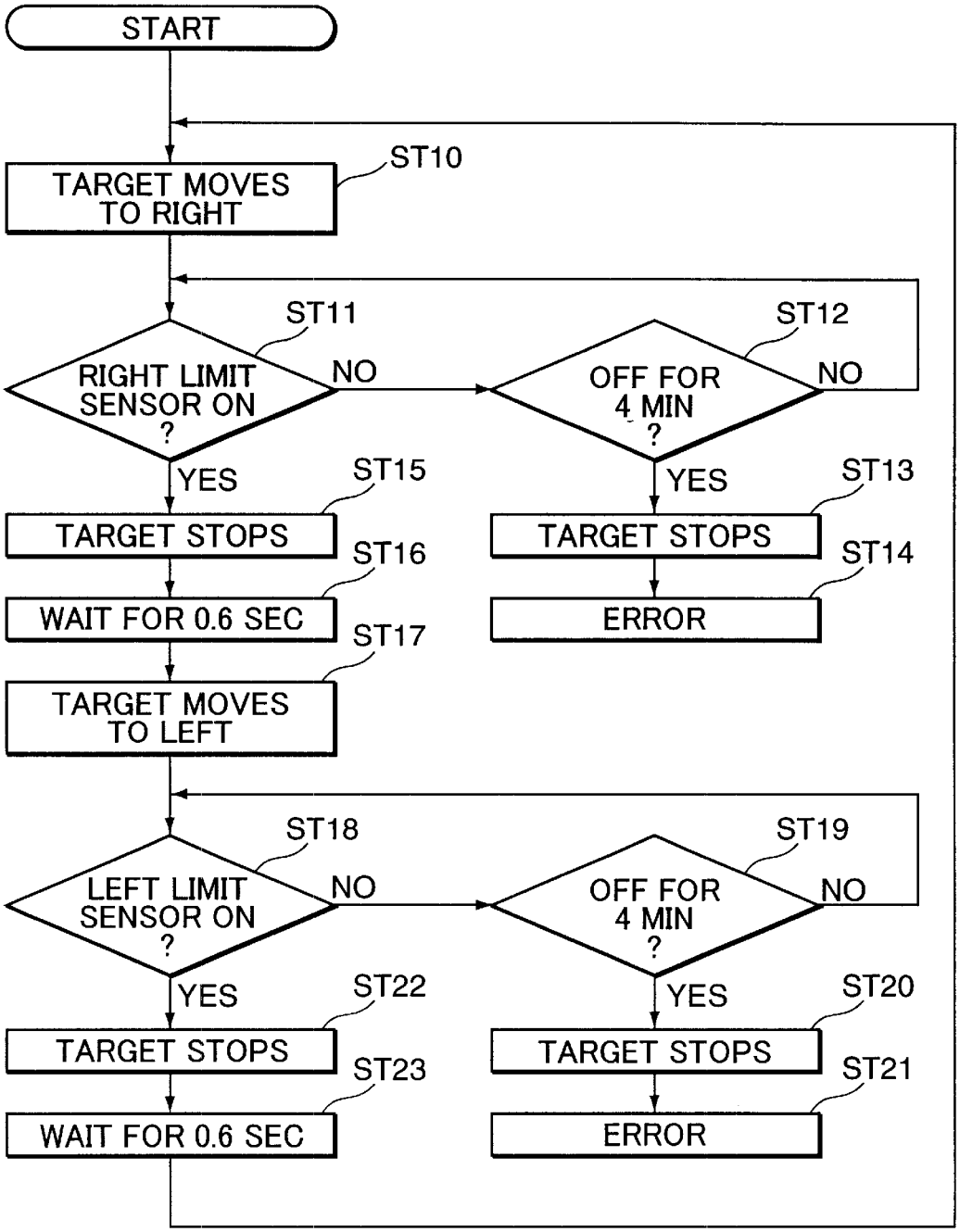
FIG. 31 is a flow chart showing a target movement control executed in the shooting game machine of FIG. 1.

In this target moving mode, as shown in FIG. 31, the interfering plates 19*c*, 19*d* and the targets 25, 33 are moved to the right (Step ST10) and then it is discriminated whether the right limit sensor 17*a* is on (Step ST11). If the right limit sensor 17*a* is off, Step ST12 follows to judge whether an off-period is 4 sec. or longer, i.e. the right limit sensor 17*a* has been off for 4 sec. or longer. This routine returns to Step S11 if the off-period is less than 4 sec. On the other hand, if the off-period is 4 sec. or longer, a corresponding one of the interfering plates 19*c*, 19*d* and the targets 25, 33 is stopped (Step ST13) and an occurrence of an error is notified (Step ST14).

If the right limit sensor 17*a* is on in Step ST11, the interfering plates 19*c*, 19*d* and the targets 25, 33 are temporarily stopped (Step ST15), and they are moved to the left (Step ST17) after waiting for 0.6 sec. (Step ST16).

It is then discriminated whether the left limit sensor 17*b* is on (Step ST18). If the left limit sensor 17*b* is off, Step ST19 follows to judge whether an off-period is 4 sec. or longer, i.e. the left limit sensor 17*b* has been off for 4 sec. or longer. This routine returns to Step S18 if the off-period is less than 4 sec. On the other hand, if the off-period is 4 sec. or longer, the target (or interfering plate) is stopped (Step ST20) and an occurrence of an error is notified (Step ST21).

If the left limit sensor 17*b* is on in Step ST18, the target (or interfering plate) is stopped (Step ST22), and this routine returns to Step ST10 to move the target (or interfering plate) to the right after waiting for 0.6 sec. (Step ST23). This target moving mode is executed by the target movement controller 101.

Figure 30:
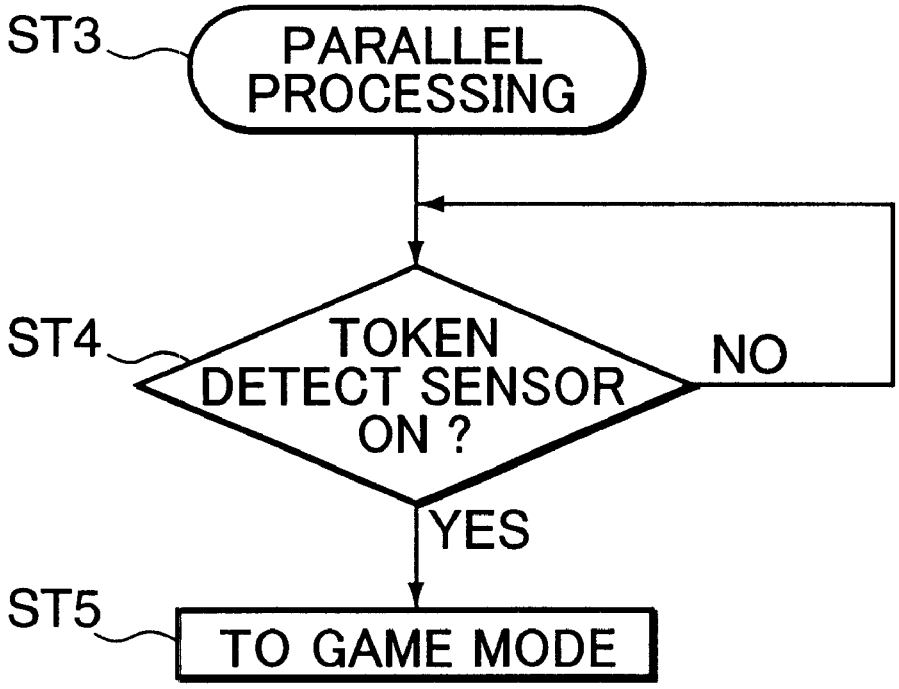
FIG. 30 is a flow chart showing a token detection control executed in the shooting game machine of FIG. 1.

Simultaneously with the target movement control, parallel processing is started (Step ST3) to enter the game mode as shown in FIG. 30. It is then discriminated whether the token detecting sensor 74 is on (Step ST4), and this routine returns to Step ST4 when the sensor 74 is off while the game mode is entered (Step ST5) when the sensor 74 is on. This parallel processing is executed by the game controller 107.

Figure 32:
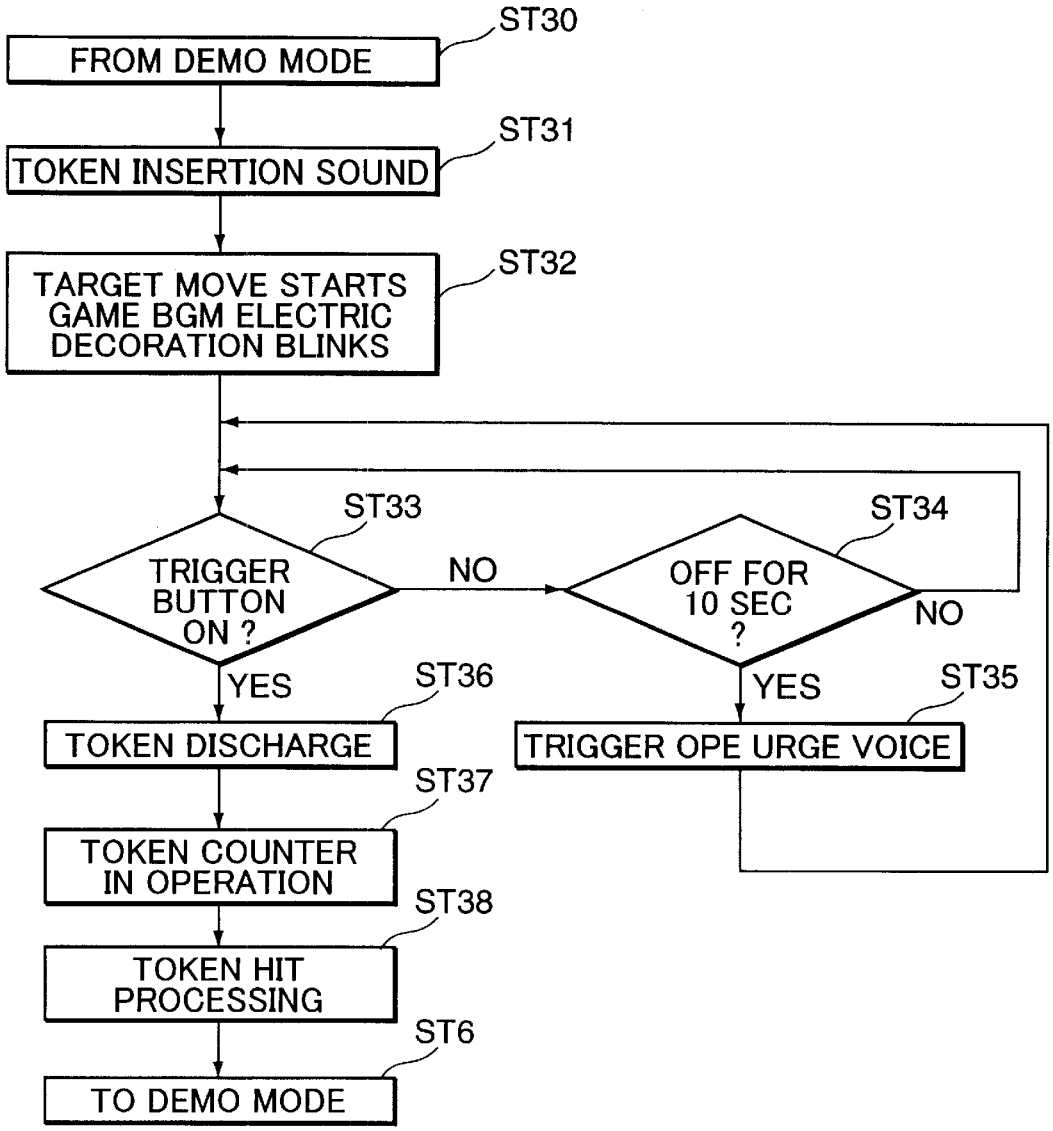
FIG. 32 is a flow chart showing a game mode control executed in the shooting game machine of FIG. 1.

In the game mode, as shown in FIG. 32, the demonstration mode is stopped (Step ST30), and a sound presentation is made for the insertion of the token 61 (Step ST31). Subsequently, the aforementioned target moving mode is started, the BGM for the game is outputted and the lamps 7*a* and the like are blinked (Step ST32). It is then discriminated whether the trigger 78 has been pulled (Step ST33). Unless the trigger 78 has been pulled, it is discriminated whether the trigger 78 has not been pulled for 10 sec. (Step ST34). If the trigger 78 has not been pulled for 10 sec., this routine returns to Step ST33 after a sound output is made in order to urge the game player to pull the trigger 78 (Step ST35). On the other hand, this routine directly returns to Step ST33 if the trigger 78 is discriminated not to have been pulled for less than 10 sec. in Step ST34. This game mode is executed by the game mode controller 108.

If it is judged that the trigger 78 has been pulled in Step ST33, the token discharge mode is executed (Step ST36).

Figure 33:
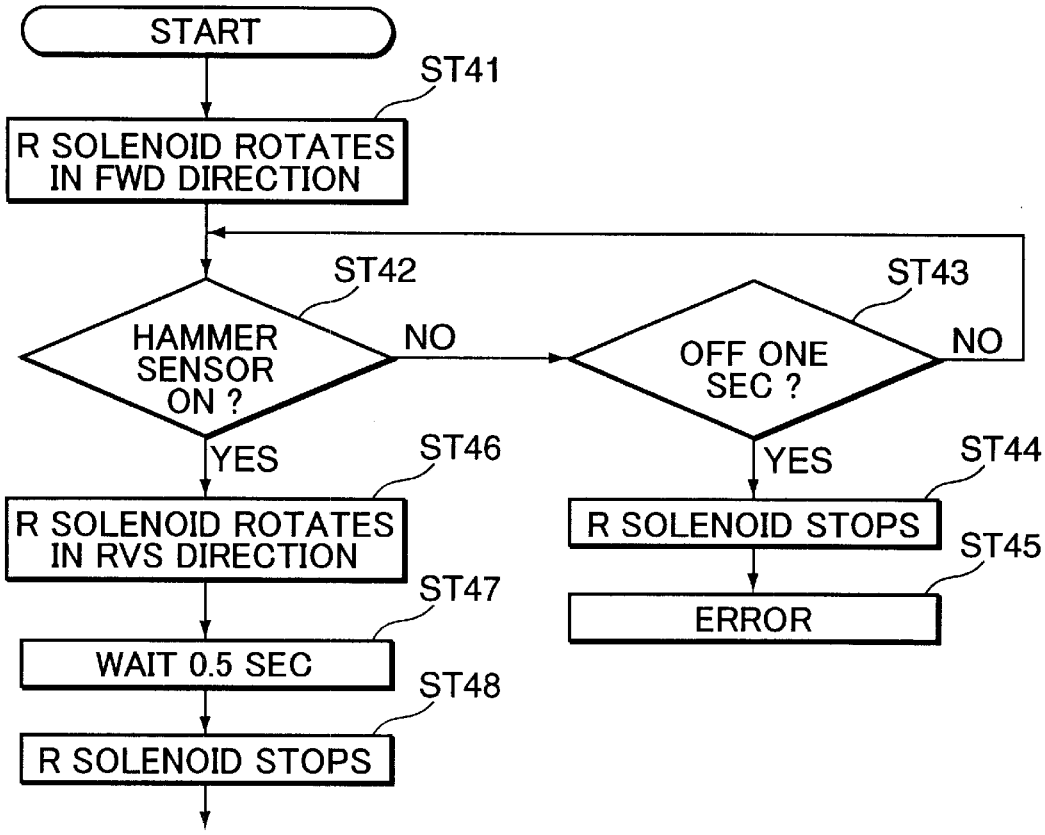
FIG. 33 is a flow chart showing a token discharging mode control executed in the shooting game machine of FIG. 1, FIGS. 34A and 34B are a flow chart showing a token hit processing mode control executed in the shooting game machine of FIG. 1.

In the token discharge mode, as shown in FIG. 33, the rotary solenoid 77*h* is rotated in forward direction (Step ST41) and then it is discriminated whether the photosensor (hammer sensor) 77*j* is on (Step ST42). If the hammer sensor 77*j* is off, it is discriminated whether it has been off for 1 sec. or longer (Step ST43). If the off-period of the hammer sensor 77*j* is 1 sec. or longer, the rotary solenoid 77*h* is stopped (Step ST44) and an occurrence of an error is notified (Step ST45).

On the other hand, if the hammer sensor 77*j* is on in Step ST42, the rotary solenoid 77*h* is rotated in reverse direction (Step ST46), and the rotation thereof is stopped (Step ST48) after waiting for 0.5 sec. (Step ST47). Subsequently, in Step ST37 of FIG. 32, a counter for counting the number of discharged tokens 61 is incremented by one. The token hit processing mode is then executed (Step ST38), followed by Step ST6 of FIG. 29. The token discharge mode is executed by the token discharge mode controller 109.

Figure 34A:
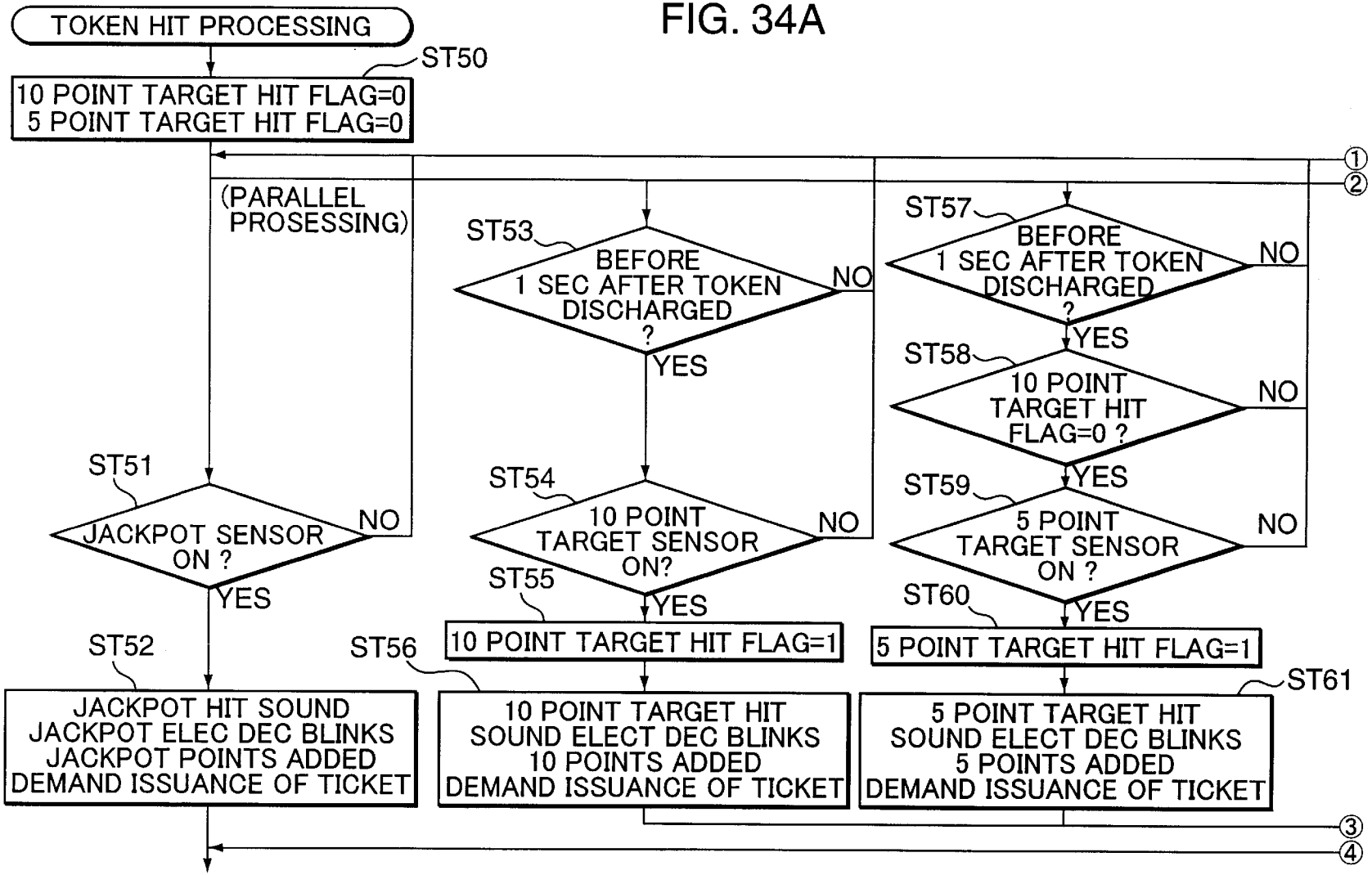
Figure 34B:
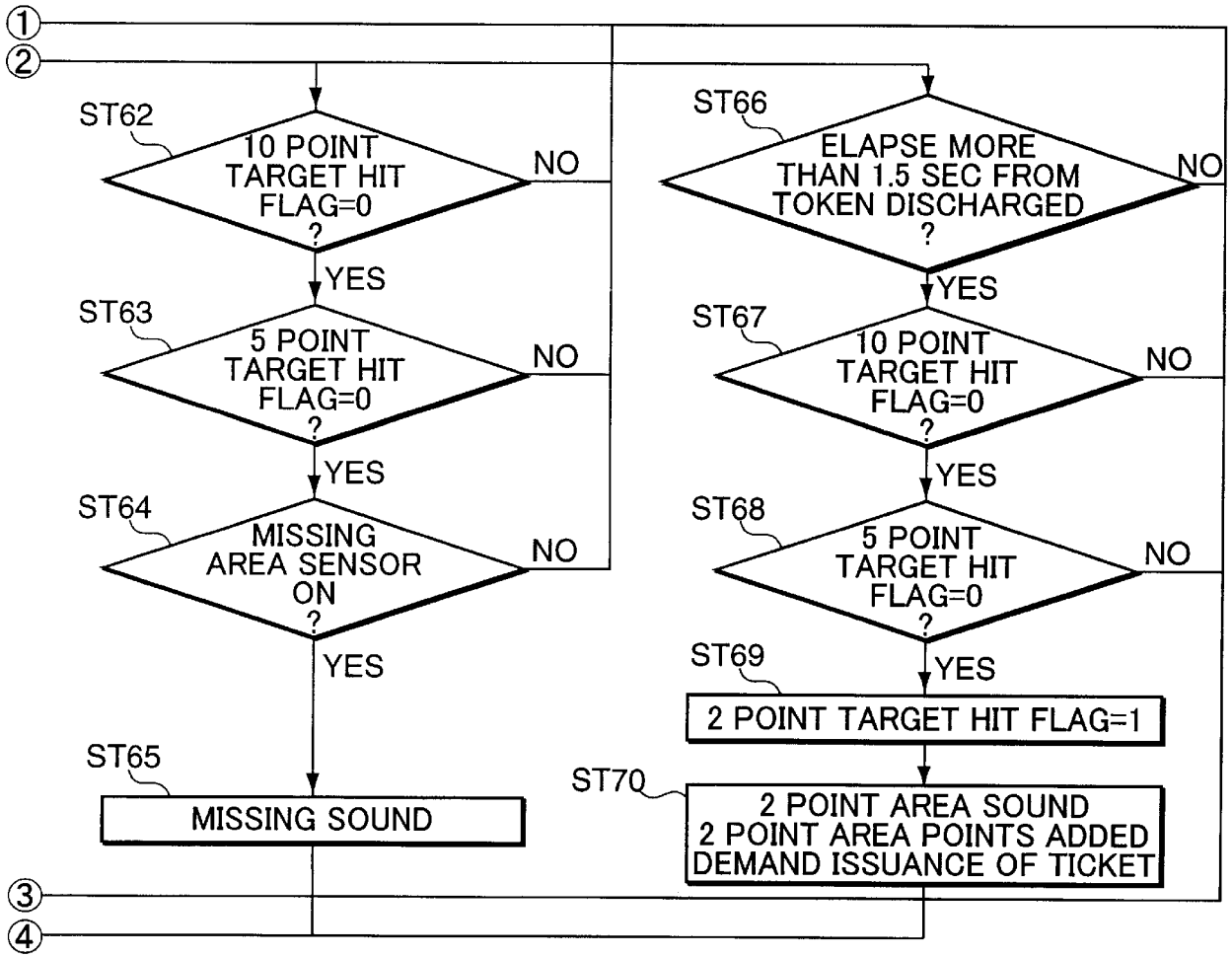

In the token discharge mode, as shown in FIGS. 34A and 34B, a hit flag of the target 33 representing 10 points is reset to 0 and hit flags of the targets 25 representing 5 points are reset to 0 (Step ST50) and then five parallel processings are executed thereafter.

In the first parallel processing, it is discriminated whether the microswitch (jackpot sensor) 36 is on (Step ST51) and this discrimination is repeated until the jackpot sensor 36 is turned on. When the jackpot sensor 36 is turned on, a sound representing the hit of the jackpot 33*a* is outputted, the lamps 7*a* and the like are blinked to notify the hit of the jackpot 33*a*, points corresponding thereto are added, and a ticket issuance requirement is given (Step ST52). The first parallel processing is executed by the first parallel processing controller 111.

In the second parallel processing, it is discriminated whether 1 sec. has not yet elapsed after the discharge of the token 61 (Step ST53), and it is then discriminated whether the optical sensor 34 relating to the target 33 is on (Step ST54). The above discriminations are repeated before 1 sec. elapses after the discharge of the token 61 and until the target sensor 34 is turned on. If the discrimination criteria are satisfied, the target-hit flag of 10 points is incremented to 1 in Step ST55. A sound representing the hit of the target of 10 points is outputted, the electric decorations (lamps 7*a* and the like) for the hit of this target are blinked, points corresponding thereto are added, and the ticket issuance requirement is given (Step ST56).

The second parallel processing is executed by the second parallel processing controller 112. In the third parallel processing, it is successively discriminated whether 1 sec. has not yet elapsed after the discharge of the token 61 (Step ST57), whether the target-hit flag of 10 points is set at 0 (Step ST58) and whether the target sensor (optical sensor 28) corresponding to 5 points is on (Step ST59). The above discriminations are repeated before 1 sec. elapses after the discharge of the token 61 and until the target-hit flag of 10 points is set at 0 and the target sensor (optical sensor 28) is turned on. If the discrimination criteria are satisfied, the target-hit flag of 5 points is incremented to 1 in Step ST60. A sound representing the hit of the target of 5 points is outputted, the electric decorations (lamps 7*a* and the like) for the hit of this target are blinked, points corresponding thereto are added, and the ticket issuance requirement is given (Step ST61). The third parallel processing is executed by the third parallel processing controller 113.

In the fourth parallel processing, it is successively discriminated whether the target-hit flag of 10 points is set at 0 (Step ST62), whether the target-hit flag of 5 points is set at 0 (Step ST63), and whether a missing area sensor (microswitch 85) is on (Step ST64). The above discriminations are repeated until the target-hit flag of 10 points is set at 0, the target-hit flag of 5 points is set at 0 and the missing area sensor (microswitch 85) is turned on. If the discrimination criteria are satisfied, a sound representing the missing of the targets is outputted (Step ST65). The fourth parallel processing is executed by the fourth parallel processing controller 114.

In the fifth parallel processing, it is successively discriminated whether 1.5 sec. has elapsed after the discharge of the token 61 (Step ST66), whether the target-hit flag of 10 points is set at 0 (Step ST67) and whether the target-hit flag of 5 points is set at 0 (Step ST68). The above discriminations are repeated until 1.5 sec. elapses after the discharge of the token 61, the target-hit flag of 10 points is set at 0 and the target-hit flag of 5 points is set at 0. If the discrimination criteria are satisfied, a target-hit flag of 2 points is incremented to 1 in Step ST69. A sound representing the hit of the target of 2 points is outputted, points corresponding thereto are added, and the ticket issuance requirement is given (Step ST70). The fifth parallel processing is executed by the fifth parallel processing controller 115.

The priority of the parallel processings in the above token hit processing mode is in the order of the first, second, third, fourth and fifth processings. Since the token 61 may hit either one (or both) of the 10-points target and the jackpot after hitting the 5-points target, all the parallel processings are continued even if a certain parallel processing is completed. Likewise, since the token 61 may hit the jackpot after hitting the 10-points target, all the parallel processings are continued even if a certain parallel processing is completed.

Thereafter, as shown in FIG. 29, this routine proceeds to Step ST6 to execute the demonstration mode. In Step ST6, it is discriminated whether the proximity sensor 8 has been off for 30 sec. This discrimination is made until the proximity sensor 8 has been off for 30 sec., and the targets are stopped and the BGM is stopped (Step ST7) when the off-period of the proximity sensor 8 reaches 30 sec. Thereafter, in Step ST8, it is discriminated whether the proximity sensor 8 is on. This routine returns to Step ST1 when the proximity sensor 8 is on while proceeding to Step ST9 when it is off. In Step ST9, it is discriminated whether the proximity sensor 8 has been off for 15 min. and this routine returns to Step ST8 unless the sensor 8 has been off for 15 min while returning to Step ST1 if the sensor 8 has been off for 15 min. If the token insertion sensor is turned on during the execution of Steps ST1, ST2, ST6, ST7 and ST8, the demonstration mode is completed and the game mode is entered. The demonstration mode is executed by the game controller 107.

If the ticket issuance requirement is made in the token hit processing mode, a ticket issuing mode is executed by the ticket issuance controller 106.

Figure 35:
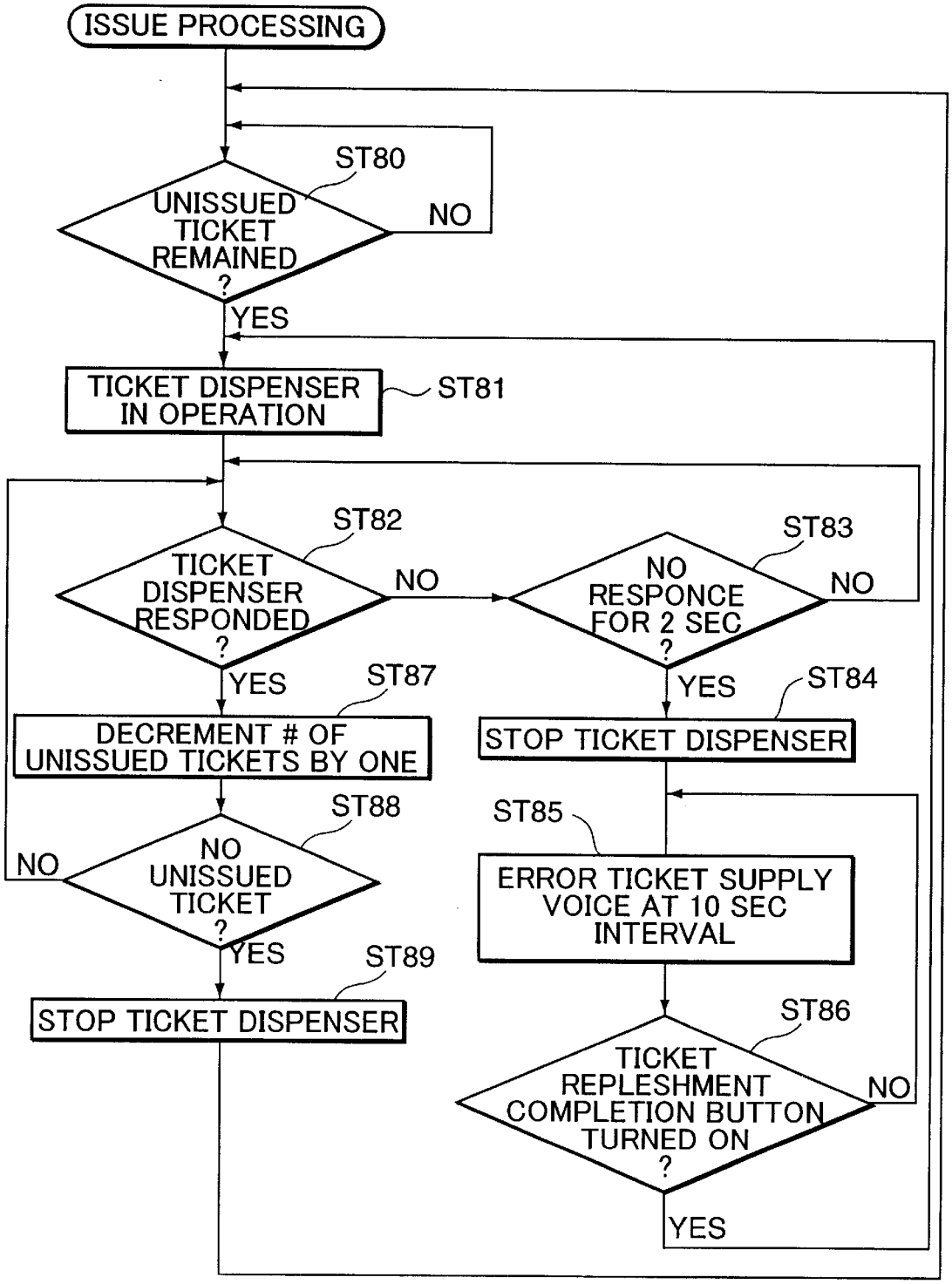
FIG. 35 is a flow chart showing a ticket issuing mode control executed in the shooting game machine of FIG. 1.

As shown in FIG. 35, it is repeatedly discriminated whether there is any unissued ticket (Step ST80). If there is any unissued ticket, the ticket issuing device (ticket dispenser) provided in the casing 2 is operated (Step ST81) and it is discriminated whether a response signal has been inputted from the ticket issuing device (Step ST82). In the absence of the response signal, an operation signal is given to the ticket issuing device and it is discriminated whether the response signal has been inputted during 2 sec. (Step ST83). If no response signal has been inputted during 2 sec., the ticket issuing device is stopped (Step ST84) and a sound output representing an occurrence of an error or replenishment of tickets is given at intervals of, e.g. 10 sec. (Step ST85). Thereafter, a ticket replenishment completion button provided near the ticket issuing device in the casing 2 has been turned on (Step ST86). This routine returns to Step ST85 if this button is off while returning to Step ST81 if it is on. This routine returns to Step ST82 if the response signal is inputted during 2 sec.

On the other hand, if the response signal is inputted in Step ST82, the ticket issuing device completes issuance of one ticket to reduce the unissued tickets by one (Step ST87). It is then discriminated whether there still remains any unissued ticket (Step ST88). Step ST80 follows if there still remains any unissued ticket. On the other hand, if there is no more unissued ticket, the ticket issuing device is stopped (Step ST89) and this routine returns to Step ST80.

As described in detail above, the simulated gun according to the foregoing embodiment uses the disk-shaped token 61 as a bullet, and is provided with the gunbarrel 75 whose cross section along a direction normal to the longitudinal direction in which the token 61 moves is vertically long and has vertical and horizontal dimensions set substantially equal to the diameter and the thickness of the token 61, respectively, the token hitting position C set at the inner back position of the gunbarrel 75, the hammer 77*a* provided at the inner back position of the gunbarrel 75, reciprocatingly movable between the advanced position where it hits the rear part of the token 61 set at the token hitting position C and the retracted position reached by being pulled back, and adapted to hit the token 61 set at the token hitting position C, and the trigger 78 for reciprocatingly moving the hammer 77*a*. Accordingly, when the trigger 78 is pulled, the hammer 77*a* is advanced after being retracted and hits the token 61 set at the token hitting position C at the inner back position of the gunbarrel 75 as being advanced. Then, the token 61 is discharged through the muzzle 51 while being caused to stand by the gunbarrel 75 having a vertically long cross section. As a result, the token 61 flies in the air in its standing state. Therefore, the trajectory of the token 61 can easily pass the target position.

Further, in the simulated gun according to the foregoing embodiment, the coil spring 77*q* (elastic member) for hitting the token 61 is so mounted on the hammer 77*a* as to come into contact with the rear part of the token 61 set at the token hitting position C. Since the coil spring 77*q* mounted on the hammer 77*a* hits the rear part of the token 61, the token 61 can be flown with a larger force as compared to a case where the hammer 77*a* directly hits the token 61.

Further, the simulated gun according to the foregoing embodiment is provided with the token inserting portion 56 arranged obliquely upward from the token hitting position C and having a slit-shaped opening, a pair of stoppers 72*a*, 72*b* adapted to receive the token 61 to be used and inserted through the token inserting portion 56 and spaced apart by a distance smaller than the diameter of the token 61, and the discharge member 73 provided below the stoppers 72*a*, 72*b* for discharging the smaller-diameter tokens not to be used to the outside. Thus, when the token 61 is inserted through the token inserting portion 56, it is received by the pair of stoppers 72*a*, 72*b* provided below the token inserting portion 56. However, since the spacing between the stoppers 72*a*, 72*b* is specified so that smaller-diameter tokens not to be used drop by passing between the stoppers 72*a*, 72*b* without being received thereby. On the other hand, the insertion preventing means (restricting members 70, 71) provided near the token inserting portion 56 prevents the insertion of larger-diameter tokens not to be used. Thus, the inserted tokens can be sorted and selectively used.

Further, the simulated gun according to the foregoing embodiment is provided with a pair of stoppers 72*a*, 72*b* each having one end thereof supported while the other end thereof is hanging free, and the token moving means (token push-out portion 76) for moving the token 61 caused to stand by the pair of stoppers 72*a*, 72*b* on the stoppers 72*a*, 72*b*, dropping it from the ends of the stoppers 72*a*, 72*b* to set it in the token hitting position C. Accordingly, if the token 61 received by the stoppers 72*a*, 72*b* is moved toward the free ends of the stoppers 72*a*, 72*b* to be dropped from the ends of the stoppers 72*a*, 72*b*, it can be set in the token hitting position C.

Although up to two tokens 61 can be inserted onto the pair of stoppers 72*a*, 72*b* provided below the token inserting portion 56 in the simulated gun according to the foregoing embodiment, the present invention is not limited thereto. The inventive simulated gun may be constructed such that only one token or three or more tokens are insertable.

Although the cross section of the hollow of the gunbarrel 75 for discharging the token 61 is long along vertical direction in the simulated gun according to the foregoing embodiment, the present invention is not limited thereto.

The longitudinal dimension of the cross section may be slightly inclined toward horizontal direction within such a range as not to be largely influenced by buoyancy.

Further, in the shooting game machine to which the simulated gun according to the foregoing embodiment is applied, the disk-shaped token 61 which is relatively heavy and is shaped to easily fly is discharged from the gun 50 as a bullet. Accordingly, the trajectory is likely to meet a target position and the aimed position and the actually hit target coincide with a high probability although it depends on the game player's skill. As a result, the shooting ability of the game player can be reflected on the shooting result, thereby making the shooting game more ingenious and interesting. Further, since the optical sensors 28, 34 and the microswitches 36, 85 are provided as the detecting means, the game player's skill can be securely evaluated by the score detected by the detecting means.

Further, in the shooting game machine to which the simulated gun according to the foregoing embodiment is applied, a plurality of kinds of targets including the targets 25, 33 arranged in two rows shifted in forward and backward directions when viewed from the game player and the jackpot 33*a* which is an opening formed in the rear target 33 are provided in the casing 2, and the respective targets are reciprocated along the longitudinal direction of the guide rails 12 (transverse direction when viewed from the game player). Accordingly, it is difficult to aim at the targets by the gun 50, which leads to an improved ingenuity of the shooting game. Further, since the front targets 25 stand as a hindrance to the rear target 33, the game can be made more ingenious and interesting. Furthermore, since the interfering plates 19*c*, 19*d* are provided before the front targets 25, the targets 25 and the interfering plates 19*c*, 19*d* are moved at different speeds along the guide rails 12, the game can be made even more ingenious and interesting.

Since the gun 50 is installed such that the muzzle 51 can be aimed in an upward, downward, leftward, rightward, oblique direction or any direction when viewed from the game player, any desired target or jackpot can be aimed at.

In the shooting game machine to which the simulated gun according to the foregoing embodiment is applied, 5 points are given in the case that the token 61 hits the front target 25 and 10 points are given in the case that the token 61 hits the rear target 33. Accordingly, the game player is tempted to aim at the rear target 33 which has higher points, i.e. is more difficult to hit by being interfered by the front targets and the like, making the game further more ingenious and interesting. Further, points given in the case that the token 61 hits the jackpot 33 are a total of points given upon hitting the targets 25, 33, etc. until the jackpot 33*a* is next hit by the token 61 after previous hitting. Accordingly, the game player can enjoy an improvement in his skill in the case that he can hit the jackpot 33*a*, which is difficult to hit, with the token 61. Since the game player can get many tickets in this case, the game can be made extremely interesting.

In the shooting game machine to which the simulated gun according to the foregoing embodiment is applied, 2 points are given when the token 61 passes the interfering plates 19*a*, 19*b*, 5 points are given when the target 25 is hit, 10 points are given when the target 33 is hit, and the jackpot value is given when the jackpot 33*a* is hit. However, according to the present invention, the respective points may be set at desired values.

Although two front targets 25 are provided in the shooting game machine to which the simulated gun according to the foregoing embodiment is applied, one, three or more front targets 25 may be provided according to the present invention.

Although one rear target 33 is provided in the shooting game machine to which the simulated gun according to the foregoing embodiment is applied, two or more rear targets 33 may be provided according to the present invention. In this case, the jackpot may be provided in each target or in one or more targets or may be omitted.

Although the targets are provided in two rows shifted in forward and backward directions when viewed from the game player in the shooting game machine to which the simulated gun according to the foregoing embodiment is applied, they may be provided in one, three or more such rows. In the case of only one row, it is preferable to mixedly use the targets 25 and 33 in order make the game more interesting.

Although the targets 25, 33 are moved along the guide rails 12 (transverse direction when the game player looks at the shooting game machine 1) in the shooting game machine to which the simulated gun according to the foregoing embodiment is applied, they may be moved in oblique directions or forward and backward directions when viewed from the game player or may make a circular movement on a horizontal or vertical plane or a plane inclined at an angle between the horizontal and vertical planes according to the present invention. Further, in the case of moving the targets in a circular manner, the targets may be arranged not only on one circle, but also on two, three or more concentric circles.

Although various targets are moved along the guide rails 12 in the shooting game machine to which the simulated gun according to the foregoing embodiment is applied, they may be stationary according to the present invention.

Although two interfering plates 19*c*, 19*d* are provided before the targets 25 in the shooting game machine to which the simulated gun according to the foregoing embodiment is applied, one, three or more interfering plates may be provided according to the present invention.

Although the interfering plates 19*c* and 19*d* are transversely moved when viewed from the game player in the foregoing embodiment, they may be stationary or may be omitted according to the present invention.

Although the moving speeds of the interfering plates 19*c*, 19*d*, the targets 25 and the target 33 differ from each other in the shooting game machine to which the simulated gun according to the foregoing embodiment is applied, the present invention is not limited thereto. For example, they may be all moved in the same pattern or at least two of them are moved in the same pattern. In such a case, the targets and/or the interfering plates arranged one after the other and transversely moved in the same pattern when viewed from the game player may be obliquely shifted to each other or located at overlapping positions when viewed from front.

Although not clearly mentioned in the shooting game machine to which the simulated gun according to the foregoing embodiment is applied, the heights of the interfering plates 19*c*, 19*d*, the targets 25 and the target 33 may be differed. In such a case, they may be arranged such that the taller ones are located more forward than the shorter ones, or the shorter ones are located more forward than the taller ones, or desired heights are set regardless of their positions along forward and backward directions.

Although the ticket issuing device for issuing the tickets according to the result of the game is provided in the shooting game machine to which the simulated gun according to the foregoing embodiment is applied, a device for paying off medals according to the result of the game may be provided according to the present invention.

Although the tokens are used as flying members in the shooting game machine to which the simulated gun according to the foregoing embodiment is applied, coins, medals, disk-shaped or substantially disk-shaped metallic members may be used according to the present invention. The substantial disk-shape of the flying members may be an octagon or like polygon approximate to a circle.

As described above, the inventive simulated gun uses the disk-shaped or substantially disk-shaped flying member made of a metal as a bullet and discharges it forward and is provided with the gunbarrel having the hollow whose cross section along a direction normal to the longitudinal direction in which the flying member moves is vertically long and has vertical and horizontal dimensions set substantially equal to the diameter and the thickness of the flying member, respectively, the flying member hitting position set at the inner back position of the gunbarrel; the hammer provided at the inner back position of the gunbarrel, reciprocatingly movable between the advanced position where it hits the rear part of the flying member set at the flying member hitting position and the retracted position reached by being pulled back, and adapted to hit the flying member set at the flying member hitting position, and the trigger for reciprocatingly moving the hammer.

Accordingly, when the trigger is pulled, the hammer is advanced after being retracted and hits the flying member set at the flying member hitting position at the inner back position of the gunbarrel as being advanced. Then, the flying member is discharged through the muzzle while being caused stand by the gunbarrel having a vertically long cross section. As a result, the flying member flies in the air in its substantially standing state. Therefore, the trajectory of the flying member can easily pass the target position.

The simulated gun is also provided with the flying member inserting portion provided obliquely upward from the flying member hitting position and having a slit-shaped opening, a pair of stoppers adapted to receive the flying member to be used and inserted through the flying member inserting portion and spaced apart by a distance smaller than the diameter of the flying member, and the discharge means provided below the stoppers for discharging the smaller-diameter flying members not to be used to the outside. Thus, when the flying member is inserted through the flying member inserting portion, it is received by the pair of stoppers provided below the flying member inserting portion. However, since the spacing between the stoppers is specified so that smaller-diameter flying members not to be used drop by passing between the stoppers without being received thereby. Thus, the inserted flying members can be sorted and selectively used.

Each of the pair of stoppers has one end thereof supported while the other end thereof is hanging free, and the flying member moving means for moving the flying member caused to stand by the pair of stoppers on the stoppers, dropping it from the ends of the stoppers to set it in the flying member hitting position. Accordingly, if the flying member received by the stoppers is moved toward the free ends of the stoppers to be dropped from the ends of the stoppers, it can be set in the flying member hitting position.

Further, since the insertion preventing means is provided near the flying member inserting portion for preventing the insertion of large-diameter flying members not to be used. Thus, the inserted flying members can be sorted and selectively used.

Furthermore, since the elastic member for hitting the flying member is so mounted on the hammer as to hit the rear part of the flying member set at the flying member hitting position, the flying member can be flown with a stronger force as compared to a case where the hammer directly hits the flying member.

This application is based on Japanese patent application serial no. 2000-014259 filed on Jan. 20, 2000, the contents of which are hereby incorporated by reference.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A simulated gun for use with a disk-shaped or substantially disk-shaped flying member which is forwardly discharged, the simulated gun comprising:

a gun barrel having a hollow, a cross section of said hollow along a direction normal to a flying direction of the flying member being vertically long and having vertical and horizontal dimensions set substantially equal to a diameter and a thickness of the flying member, respectively, and a flying member hitting position being set at an inner back position of the gun barrel, said gun barrel extending substantially in a horizontal direction and the hollow extending upwardly towards a front end of the gun barrel;

a hammer provided at the inner back position of the gun barrel, reciprocatingly movable between an advanced position where said hammer hits a rear part of the flying member set at the flying member hitting position and a retracted position which is located rearwardly from the advanced position,; and a trigger for reciprocatingly moving the hammer.

2. A simulated gun for use with a disk-shaped or substantially disk-shaped flying member which is forwardly discharged, the simulated gun comprising:

a gun barrel having a hollow, a cross section of said hollow along a direction normal to a flying direction of the flying member being vertically long and having vertical and horizontal dimensions set substantially equal to a diameter and a thickness of the flying member, respectively, and a flying member hitting position being set at an inner back position of the gun barrel;

a hammer provided at the inner back position of the gun barrel, reciprocatingly movable between an advanced position where said hammer hits a rear part of the flying member set at the flying member hitting position and a retracted position which is located rearwardly from the advanced position;

a trigger for reciprocatingly moving the hammer; and a flying member inserting portion provided obliquely upward from the flying member hitting position and having a slit-shaped opening, a pair of stoppers adapted to receive the flying member to be used and inserted through the flying member inserting portion and spaced apart by a distance smaller than the diameter of the flying member, and a discharge portion provided below the stoppers for discharging the smaller-diameter flying members not to be used to the outside.

3. The simulated gun according to claim 2, wherein each of the pair of stoppers has one end thereof supported while the other end thereof is unsupported, and further comprising a flying member moving unit for moving the flying member in a standing posture by the pair of stoppers and for dropping the flying member from the ends of the stoppers to set it in the flying member hitting position.

4. The simulated gun according to claim 3, wherein the pair of stoppers are set such that a plurality of flying members are placed thereon.

5. The simulated gun according to claim 3, wherein an elastic member for hitting the flying member is so mounted on the hammer as to hit the rear part of the flying member set at the flying member hitting position.

6. The simulated gun according to claim 2, further comprising an insertion preventing means provided near the flying member inserting portion for preventing the insertion of large-diameter flying members not to be used.

7. The simulated gun according to claim 2, wherein the pair of stoppers are set such that a plurality of flying members are placed thereon.

8. The simulated gun according to claim 2, wherein an elastic member for hitting the flying member is so mounted on the hammer as to hit the rear part of the flying member set at the flying member hitting position.

9. A simulated gun for use with a disk-shaped or substantially disk-shaped flying member which is forwardly discharged, the simulated gun comprising:

a gun barrel having a hollow, a cross section of said hollow along a direction normal to a flying direction of the flying member being vertically long and having vertical and horizontal dimensions set substantially equal to a diameter and a thickness of the flying member, respectively, and a flying member hitting position being set at an inner back position of the gun barrel;

a hammer provided at the inner back position of the gun barrel, reciprocatingly movable between an advanced position where said hammer hits a rear part of the flying member set at the flying member hitting position and a retracted position which is located rearwardly from the advanced position;

a trigger for reciprocatingly moving the hammer;

a pair of stoppers spaced apart by a distance smaller than the diameter of the flying member thereby supportably engaging the flying member when placed thereon, each ofthe pair of stoppers having one end thereof supported while the other end thereof is unsupported; and a flying member moving unit for moving the flying member in a standing posture by the pair of stoppers and for dropping the flying member from the ends of the stoppers to set the flying member in the flying member hitting position.

10. The simulated gun according to claim 9, further comprising:

a flying member inserting portion having an opening through which the flying member can be inserted for use in the simulated gun; and an insertion preventing means provided near the flying member inserting portion for preventing the insertion of large-diameter flying members not to be used.

11. The simulated gun according to claim 9, wherein the pair of stoppers are set such that a plurality of flying members are placed thereon.

12. The simulated gun according to claim 9, wherein an elastic member for hitting the flying member is so mounted on the hammer as to hit the rear part of the flying member set at the flying member hitting position.

13. A simulated gun for use with a disk-shaped or substantially disk-shaped flying member which is forwardly discharged, the simulated gun comprising:

a gun barrel having a hollow, a cross section of said hollow along a direction normal to a flying direction of the flying member being vertically long and having vertical and horizontal dimensions set substantially equal to a diameter and a thickness of the flying member, respectively, and a flying member hitting position being set at an inner back position of the gun barrel;

a hammer provided at the inner back position of the gun barrel, reciprocatingly movable between an advanced position where said hammer hits a rear part of the flying member set at the flying member hitting position and a retracted position which is located rearwardly from the advanced position;

a trigger for reciprocatingly moving the hammer;

a flying member inserting portion having an opening through which the flying member can be inserted for use in the simulated gun; and an insertion preventing means provided near the flying member inserting portion for preventing the insertion of large-diameter flying members not to be used.

14. The simulated gun according to claim 13, wherein an elastic member for hitting the flying member is so mounted on the hammer as to hit the rear part of the flying member set at the flying member hitting position.

15. A simulated gun for use with a disk-shaped or substantially disk-shaped flying member which is forwardly discharged, the simulated gun comprising:

a gun barrel having a hollow, a cross section of said hollow along a direction normal to a flying direction of the flying member being vertically long and having vertical and horizontal dimensions set substantially equal to a diameter and a thickness of the flying member, respectively, and a flying member hitting position being set at an inner back position of the gun barrel;

a hammer provided at the inner back position of the gun barrel, reciprocatingly movable between an advanced position and a retracted position which is located rearwardly from the advanced position;

a trigger for reciprocatingly moving the hammer; and an elastic member mounted on the hammer in a manner as to hit the rear part of the flying member set at the flying member hitting position when said hammer is moved to said advanced position.

16. A simulated gun for use with a disk-shaped or substantially disk-shaped flying member which is forwardly discharged, the simulated gun comprising:

a gun barrel formed with a hollow portion defining an interior chamber having a cross section along a direction normal to a flying direction of the flying member which is substantially a rectangle having a vertical side and horizontal side, the dimensions of which are set substantially equal to a diameter and a thickness of the flying member respectively, and a flying member hitting position being set at an inner back position of the gun barrel, said gun barrel extending in a substantially horizontal direction and the interior chamber of said hollow portion extending upwards towards a front end of the gun barrel;

a hammer provided at the inner back position of the gun barrel, reciprocatingly movable between an advanced position where said hammer hits a rear part of the flying member set at the flying member hitting position and a retracted position which is located rearwardly from the advanced position; and a trigger for reciprocatingly moving the hammer.

17. A simulated gun for use with a disk-shaped or substantially disk-shaped flying member which is forwardly discharged, the simulated gun comprising:

a gun barrel formed with a hollow portion, an internal cross section of said hollow portion along a direction normal to a flying direction of the flying member is substantially a rectangle having a vertical side and horizontal side, the dimensions of which are set substantially equal to a diameter and a thickness of the flying member respectively, and a flying member hitting position being set at an inner back position of the gun barrel;

a hammer provided at the inner back position of the gun barrel, reciprocatingly movable between an advanced position where said hammer hits a rear part of the flying member set at the flying member hitting position and a retracted position which is located rearwardly from the advanced position;

a trigger for reciprocatingly moving the hammer;

a pair of stoppers spaced apart by a distance smaller than the diameter of the flying member thereby supportably engaging the flying member when placed thereon; and a flying member moving unit for moving the flying member supported by the pair of stoppers in a lateral direction to drop the flying member from the ends of the stoppers to set it in the flying member hitting position.

18. A simulated gun for use with a disk-shaped or substantially disk-shaped flying member which is forwardly discharged, the simulated gun comprising:

a gun barrel having a hollow, a cross section of said hollow along a direction normal to a flying direction of the flying member being vertically long and having vertical and horizontal dimensions set substantially equal to a diameter and a thickness of the flying member, respectively, and a flying member hitting position being set at an inner back position of the gun barrel;

a hammer provided at the inner back position of the gun barrel, reciprocatingly movable between an advanced position where said hammer hits a rear part of the flying member set at the flying member hitting position and a retracted position which is located rearwardly from the advanced position;

a trigger for reciprocatingly moving the hammer;

a pair of stoppers spaced apart by a distance smaller than the diameter of the flying member to be used by the simulated gun; and a discharge portion provided below the stoppers for discharging smaller-diameter flying members not to be used by the simulated gun to the outside.

19. A simulated gun for forwardly discharging a generally disk-shaped flying member, the simulated gun comprising:

a gun barrel including a chamber having a rearward end and an opening at a forward end through which the flying member is discharged, said chamber having a cross section along a direction normal to a flying direction of the flying member defined by vertical and horizontal dimensions which approximate a diameter and a thickness of the flying member, respectively, at least a bottom of said chamber being inclined upwardly towards said opening at said forward end of said chamber; and a hammer provided at the rearward end of the chamber, said hammer being reciprocatingly movable by a user between an advanced position where said hammer hits a rear part of the flying member set at a flying member hitting position in said chamber and a retracted position which is located rearwardly ofthe advanced position.

20. The simulated gun according to claim 19, further comprising:

a flying member inserting portion having an receiving opening through which the flying member can be inserted into the chamber for use;

a pair of stoppers spaced apart by a distance smaller than the diameter of the flying member disposed below the receiving opening for supportably accommodating the flying member to be used; and a discharge portion provided below the stoppers for discharging the smaller-diameter flying members not to be used to the outside.

* * * * *